US011066798B2

(12) United States Patent
Paczek et al.

(10) Patent No.: US 11,066,798 B2
(45) Date of Patent: Jul. 20, 2021

(54) WATER INTAKE STRUCTURE

(71) Applicant: Sea to Sky Energy Solutions Corp., Squamish (CA)

(72) Inventors: Lucas Paczek, Squamish (CA); Graham Zell, Squamish (CA); Sam MacDonald, Squamish (CA); Peter Zell, Delta (CA); Brett Robinson, Delta (CA); David Halliday, Squamish (CA); Mauricio Rene Ponga de la Torre, Vancouver (CA); Mohammad Amin Zakershobeiri, Vancouver (CA); Simon Szoke, Squamish (CA)

(73) Assignee: Sea to Sky Energy Solutions Corp., Squamish (CA)

( * ) Notice: Subject to any disclaimer, the term of this patent is extended or adjusted under 35 U.S.C. 154(b) by 0 days.

(21) Appl. No.: 16/896,116

(22) Filed: Jun. 8, 2020

(65) Prior Publication Data

US 2020/0392687 A1 Dec. 17, 2020

Related U.S. Application Data

(60) Provisional application No. 62/860,863, filed on Jun. 13, 2019.

(51) Int. Cl.
*E02B 9/04* (2006.01)
*F03B 13/08* (2006.01)

(52) U.S. Cl.
CPC ..... *E02B 9/04* (2013.01); *F03B 13/08* (2013.01)

(58) Field of Classification Search
CPC . B01D 29/445; E02B 5/08; E02B 9/04; E03F 5/14; B07B 1/12; F03B 13/08
See application file for complete search history.

(56) References Cited

U.S. PATENT DOCUMENTS

| | | | |
|---|---|---|---|
| 2,827,169 | A | 3/1958 | Cusi |
| 4,198,220 | A | 4/1980 | Keller |
| 4,250,038 | A | 2/1981 | Dryden |
| 4,415,462 | A | 11/1983 | Finch et al. |
| 5,047,148 | A | 9/1991 | Arai |

(Continued)

FOREIGN PATENT DOCUMENTS

| | | | |
|---|---|---|---|
| CH | 713881 | B1 | 12/2018 |
| EP | 3023165 | A1 | 5/2016 |

(Continued)

OTHER PUBLICATIONS

European Search Report dated Nov. 2, 2020 in respect of corresponding European Application No. EP 20179251.2.
Caoandă Effect, Wikipedia, Archived version dated Mar. 15, 2018.

*Primary Examiner* — Carib A Oquendo
(74) *Attorney, Agent, or Firm* — Nicholas Garner; Oyen Wiggs Green & Mutala LLP

(57) ABSTRACT

The present invention relates to a water intake structure according to a first aspect. The structure includes a plurality of elongate members. The elongate members couple together and are trapezoidal in lateral cross-section. There is also provided a water intake structure according to a second aspect. The structure includes a plurality of elongate members. The elongate members couple together. Each said elongate member has first and second exterior surfaces that are planar and a third exterior surface that is outwardly concave.

20 Claims, 22 Drawing Sheets

(56) References Cited

U.S. PATENT DOCUMENTS

| | | | | |
|---|---|---|---|---|
| 5,385,240 | A | 1/1995 | Egan, III et al. | |
| 5,674,386 | A * | 10/1997 | Filion | E03F 5/12 210/154 |
| 6,151,837 | A | 11/2000 | Ealer, Sr. | |
| 6,595,373 | B1 | 7/2003 | Seifert | |
| 6,641,720 | B1 | 11/2003 | Crompton et al. | |
| 7,708,494 | B2 | 5/2010 | McLaughlin | |
| 8,282,836 | B2 * | 10/2012 | Feher | E02B 9/04 210/747.5 |
| 9,611,607 | B2 * | 4/2017 | Fonkenell | E02B 5/085 |
| 2002/0175120 | A1 * | 11/2002 | Norell | B01D 29/012 210/499 |
| 2005/0246967 | A1 | 11/2005 | Esmond et al. | |
| 2008/0101867 | A1 | 5/2008 | McLaughlin | |
| 2011/0000862 | A1 | 1/2011 | Semba et al. | |
| 2011/0146802 | A1 | 6/2011 | Feher | |
| 2011/0278217 | A1 | 11/2011 | Inoue | |
| 2011/0315623 | A1 | 12/2011 | Motakef | |
| 2015/0204301 | A1 * | 7/2015 | Williams | F03B 13/08 290/52 |

FOREIGN PATENT DOCUMENTS

| | | |
|---|---|---|
| WO | 0065151 | 11/2000 |
| WO | 2007094967 | 8/2007 |
| WO | 2019220469 A1 | 11/2019 |

* cited by examiner

WATER INTAKE STRUCTURE

FIELD OF THE INVENTION

The present invention relates to a water intake structure. In particular, the invention relates to a water intake structure and a hydropower plant incorporating the same.

DESCRIPTION OF THE RELATED ART

Water intake structures with wedge-wire design bars of the known prior art may be arranged so that the sharp leading edges thereof "cut" and divert the bottom layer of water. Capacity may decrease over time as sand and gravel wear away the sharp leading edges of the bars. Reduced screen capacity from any cause may be costly for run-of-river plant operators, as this represents reduced electricity generating capacity and water intake screens may be relatively expensive pieces of equipment to replace. As sand and gravel erode the leading edges of the bars, water is deflected away from the screen instead of being diverted to the intake.

BRIEF SUMMARY OF INVENTION

There is accordingly provided, and it is an object to provide, an improved water intake structure that may overcome the above disadvantages.

There is provided a water intake structure comprising a screen elongate member shaped to optimize water intake capacity in a Coandă-effect screen. The geometric properties of the screen elongate member cross-section are described in detail herein. The water intake structure as herein described may provide an improvement in water intake capacity over known wedge-wire elongate member designs of the prior art.

There is accordingly provided a water intake structure according to a first aspect. The water intake structure includes a plurality of spaced-apart elongate members. The water intake structure includes a plurality of slots. Each slot extends between adjacent pairs of the elongate members. Each elongate member is shaped to promote a Coandă effect with portions of water passing thereon being taken in through an adjacent downstream said slot thereby.

There is also provided an elongate member for a water intake structure according to a second aspect. The elongate member has an outer surface and an upstream-facing surface extending downwards from the outer surface thereof at an acute angle relative to the outer surface thereof.

There is further provided a water intake structure according to a third aspect. The water intake structure includes a plurality of spaced-apart elongate members. Each elongate member includes an inner portion that is rigid and an outer portion along and upon which water flows. The outer portion of the elongate member is made of one of an elastomer and a thermoplastic polymer. The water intake structure includes a plurality of slots. Each slot extends between adjacent pairs of the elongate members, whereby water passes along and upon the outer portions of the elongate members, with portions of said water being taken in through said slots.

There is additionally provided a water intake structure according to a fourth aspect. The structure includes a plurality of elongate members. The elongate members couple together and are trapezoidal in lateral cross-section.

There is yet also provided a water intake structure according to a fifth aspect. The structure includes a plurality of elongate members. The elongate members couple together.

Each elongate member has first and second exterior surfaces that are planar and a third exterior surface that is outwardly concave.

There is yet further provided a water intake structure according to a sixth aspect. The structure includes a plurality of elongate members. The elongate members couple together. Each of the elongate members has an outer surface, an upstream-facing surface, and a downstream-facing surface. Each upstream-facing surface extends from the outer surface at an acute angle relative to the outer surface. A beveled edge extends between each outer surface and downstream-facing surface of the elongate member.

There is yet additionally provided a water intake structure according to a seventh aspect. The structure includes a plurality of elongate members. The elongate members couple together. Each of the elongate members is wedge-shaped in lateral cross-section. Each of the elongate members has an outer surface positioned to extend in parallel with a flow of water thereon. Each of the elongate members has a downstream beveled edge.

There is also provided a water intake structure according to an eighth aspect. The structure includes a plurality of elongate members. The elongate members couple together. Each of the elongate members has an outer surface that is outwardly convex. Each of the elongate members has an upstream-facing surface that is outwardly concave in lateral profile.

There is further provided a water intake structure according to a ninth aspect. The structure includes a plurality of elongate members. The elongate members couple together. Each of the elongate members has an outer surface aligned with a front of the structure. Each of the elongate members has an upstream-facing surface facing a top of the structure. Each of the elongate members includes an upper peripheral portion extending between the outer surface thereof and the upstream-facing surface thereof. The upper peripheral portions of the elongate members are curved in lateral profile at least in part.

There is additionally provided a water intake structure according to a tenth aspect. The structure includes a plurality of elongate members. The elongate members couple together. Each of the elongate members has an outer surface aligned with a front of the structure. Each of the elongate members has a downstream-facing surface facing a bottom of the structure. Each of the elongate members includes a lower peripheral portion extending between the outer surface thereof and the downstream-facing surface thereof. The lower peripheral portions of the elongate members are curved in lateral profile at least in part.

There is yet further provided a water intake structure according to an eleventh aspect. The structure includes a plurality of elongate members. The elongate members couple together. Each of the elongate members has an outer surface aligned with a front of the structure. Each of the elongate members has an upstream-facing surface facing a top of the structure. Each of the elongate members has a downstream-facing surface facing a bottom of the structure. Each of the elongate members includes an upper peripheral portion extending between the outer surface thereof and the upstream-facing surface thereof. Each of the elongate members includes a lower peripheral portion extending between the outer surface thereof and the downstream-facing surface thereof. The lower peripheral portion is sloped relative to the upper peripheral portion thereof.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
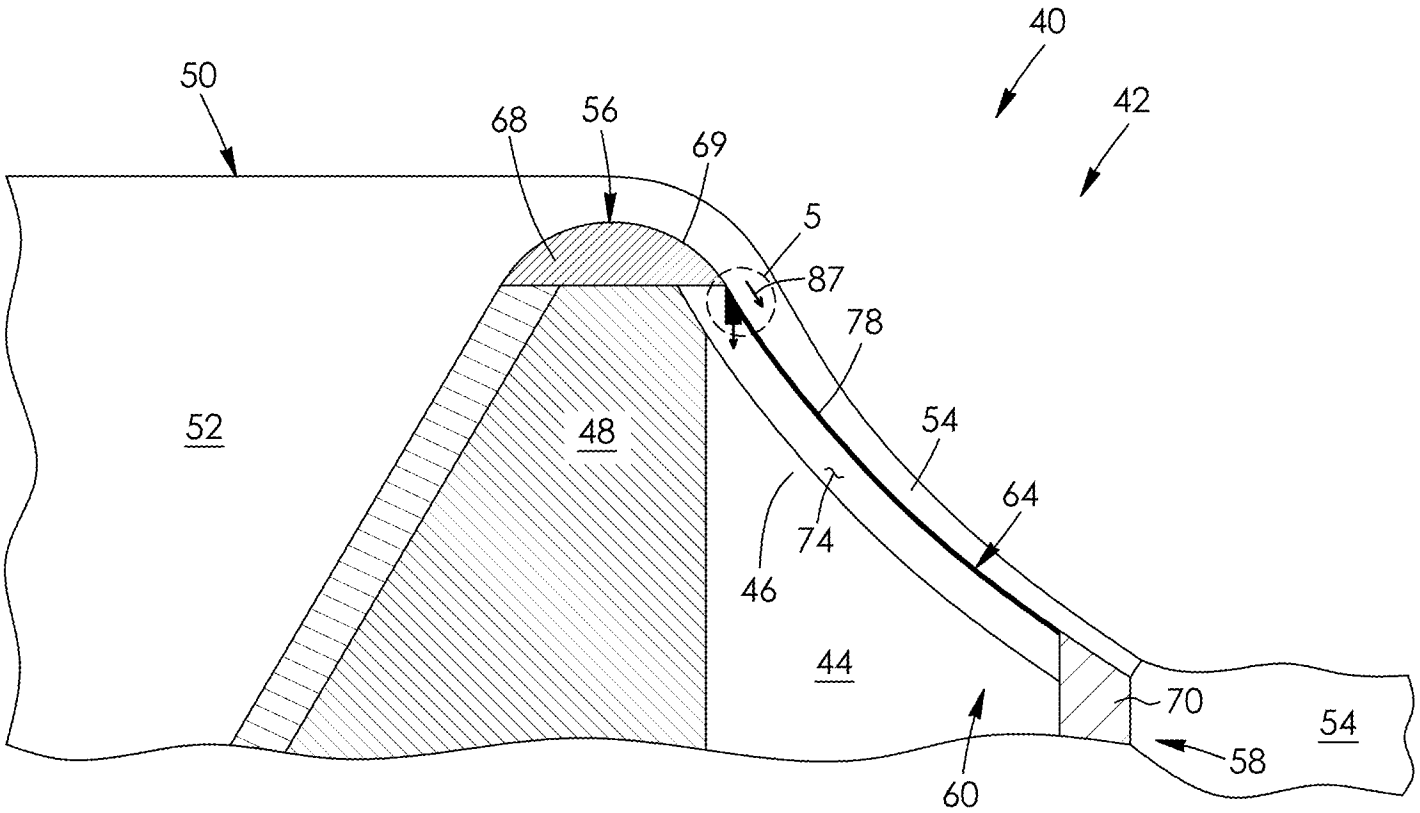
FIG. 1 is a sectional view taken along lines 1-1 of FIG. 2 of a water intake structure of a hydropower plant according to a first embodiment, showing water passing in part thereover and passing in part therethrough, and a dam and penstock, both shown in fragment.

Referring to the drawings and first to FIG. 1, there is shown a water intake structure, in this example a Coandă screen assembly 40. The assembly in this example is part of a hydropower plant 42. The plant includes a conduit, in this example a penstock 44 having an inlet 46. The plant 42 includes a barrier, in this example a dam 48 which extends across a body of water 50. The dam separates the water into a partially elevated upstream portion 52 and a downstream portion 54.

Figure 2:
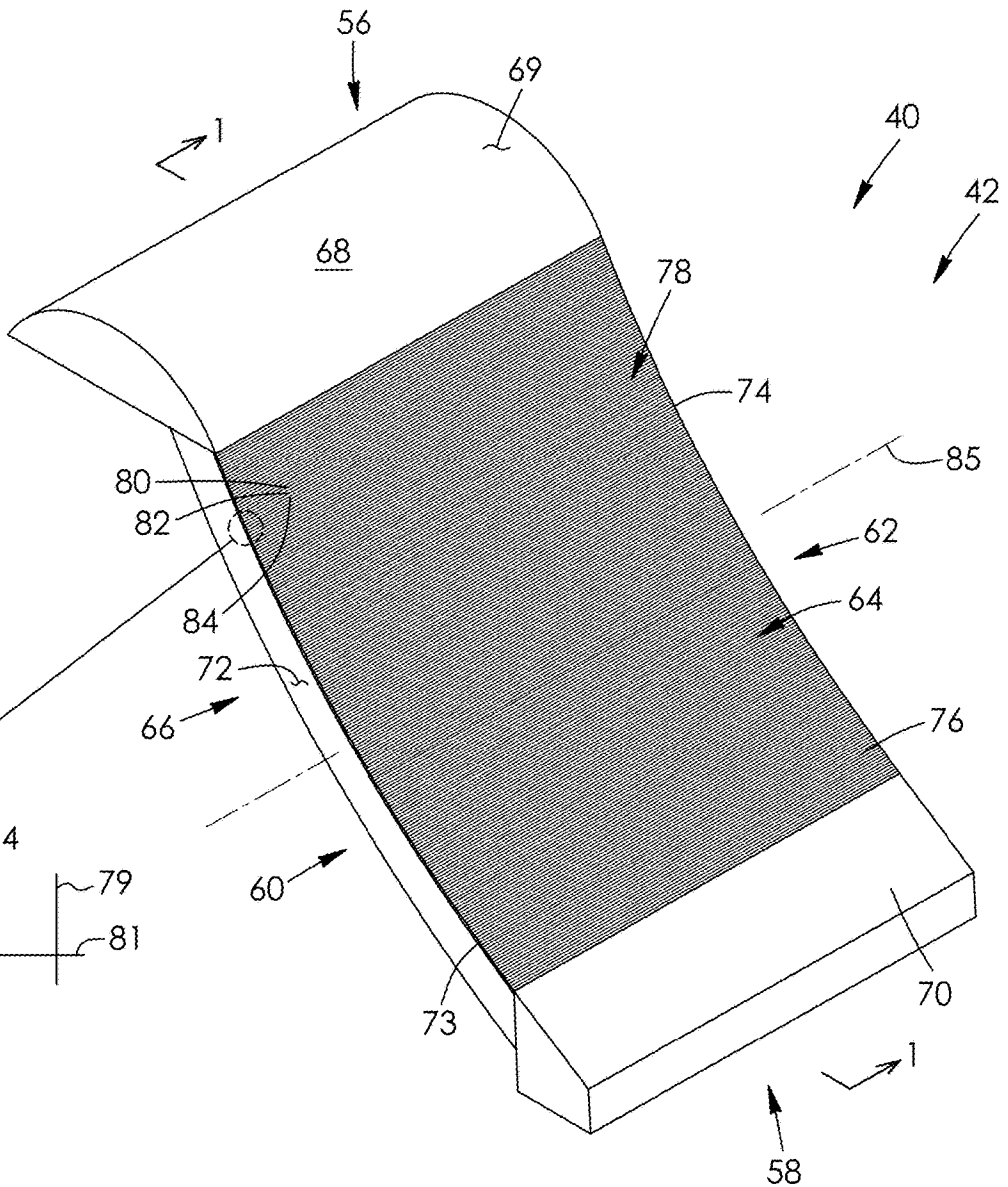
FIG. 2 is a top, right side, front perspective view of the water intake structure of FIG. 1, the water intake structure including a plurality of elongate members.

As seen in FIG. 2, the assembly 40 has a top 56, bottom 58 spaced-apart from the top, and pair of spaced-apart sides 60 and 62 extending between the top and bottom thereof. The assembly has a front 64 and a rear 66 spaced-apart from the front. The front and rear of the assembly 40 extend between the sides 60 and 62 of the assembly and between the top 56 and bottom 58 of the assembly.

Still referring to FIG. 2, the assembly includes an upper member, in this example an accelerator plate 68 extending along the top 56 thereof and between the sides 60 and 62 thereof. The accelerator plate is elongate and semi-circular in lateral cross-section in this example, with an outwardly convex exterior top surface 69.

The assembly 40 includes a lower member, in this example a runoff plate 70 extending along the bottom 58 thereof and between the sides 60 and 62 thereof. The runoff plate is elongate and has a right trapezoidal shape in lateral cross-section in this example; however this is not strictly required and the runoff plate may comprise other shapes in other embodiments.

The assembly 40 includes a pair of side support members, in this example structural beams 72 and 74. The structural beams aligns with and extends along respective sides 60 and 62 of the assembly. The structural beams 72 and 74 couples to and extends between the accelerator plate 68 and runoff plate 70. The structural beams, accelerator plate and runoff plate form an enclosure 76 which is rectangular in this example.

Figure 4:
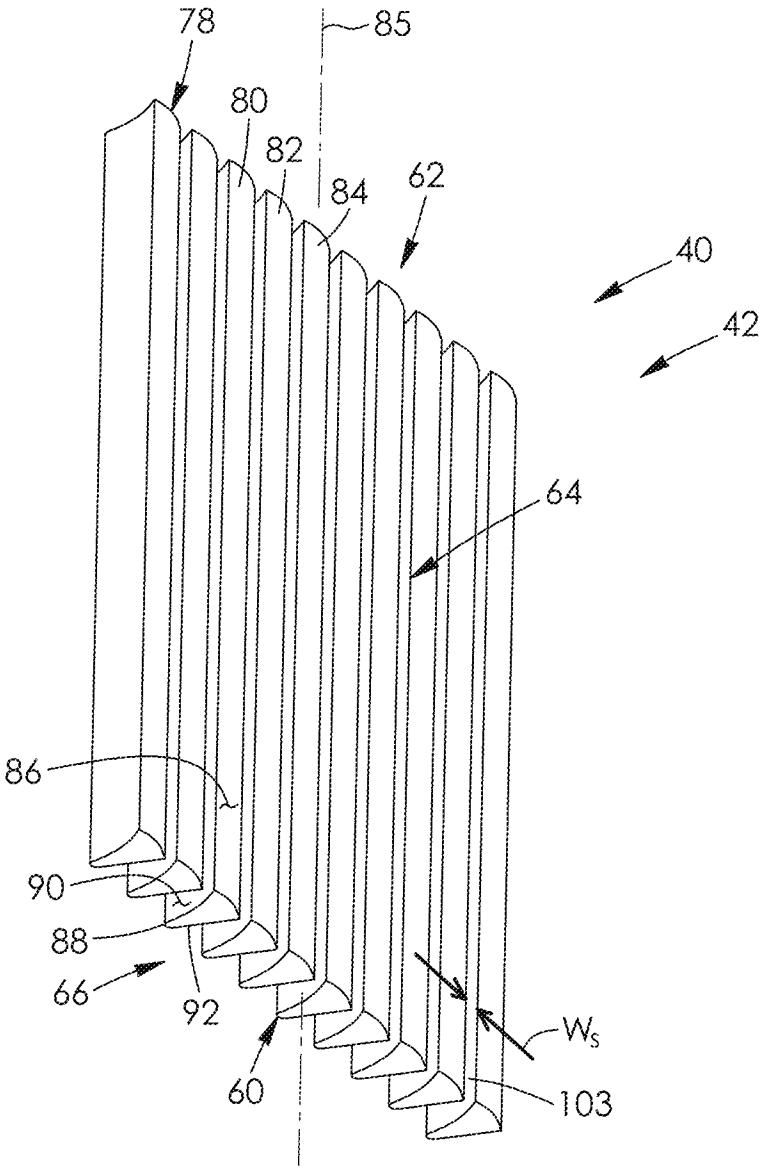
FIG. 4 is a top, right side, front perspective view of the elongate members thereof.

Still referring to FIG. 2, the assembly 40 includes a water intake screen, in this example a Coandă screen 78. Referring to FIG. 4, the screen includes a plurality of longitudinally-extending elongate members, as shown by elongate members of numerals 80, 82 and 84. The elongate members extend parallel with each other and parallel with a horizontally-extending longitudinal axis 85 of the assembly 40 in this example. As seen in FIG. 1, the screen 78 is positioned between the downstream portion 54 of the water 50 and the inlet 46 of the penstock 44. The screen is thus positioned downstream of the dam 48 and upstream portion 52 of the water 50.

Figure 3:
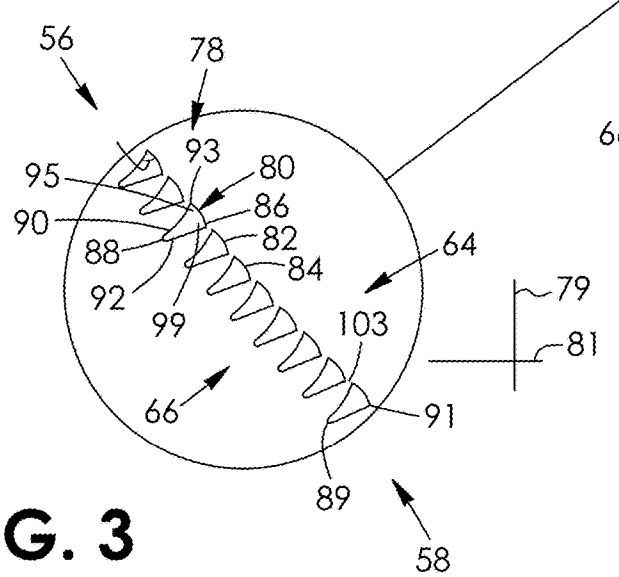
FIG. 3 is an enlarged right side elevation view of some of the elongate members of the water intake structure of FIG. 2.

The screen 78 and elongate members 80, 82 and 84 extend between and couple to structural beams 72 and 74 seen in FIG. 2 via welding 73 in this example. However, this is not strictly required and the elongate members may couple to the structural beams in other manners in other examples, such as via grooves in the structural beams, for example. The elongate members 80, 82 and 84, seen in FIG. 3, are thus coupled together and extend between the sides 60 and 62 of the assembly 40 seen in FIG. 2. The screen 78 and elongate members thereof are also positioned and extend between the accelerator plate 68 and runoff plate 70.

As seen in FIG. 3, each elongate member 80 is generally wedge-shaped in lateral cross-section in this embodiment. The elongate members taper in a direction extending from the front 64 towards the rear 66 of the assembly 60 in this example; however this is not strictly required and the elongate members need not so taper in other embodiments. Each elongate member 80 has a first exterior or outer side or surface 86 aligned with and adjacent to the front of the assembly 60. The outer surfaces of the elongate members are outwardly convex in lateral profile in this embodiment. Each elongate member 80 has a second exterior or inner surface 88 aligned with and adjacent to the rear 66 of the assembly 60. The inner surfaces of the elongate members are spaced-apart from the outer surfaces 86 of the elongate members. The inner surfaces 88 of the elongate members 80 are narrower than the outer surfaces 86 of the elongate members in this embodiment.

Still referring to FIG. 3, each elongate member 80 has a third exterior, top-facing or upstream-facing side or surface 90 that faces at least in part towards the top 56 of the assembly. The upstream-facing surfaces are outwardly concave in this embodiment. Each elongate member 80 has a fourth exterior, bottom-facing or downstream-facing side or surface 92 that faces at least in part towards the bottom 58 of the assembly 40. The downstream-facing surfaces of the elongate members are spaced-apart from the upstream-facing surfaces of the elongate members. The downstream-facing surfaces 92 are planar in this example and are sloped in this example relative to a vertical plane 79 and horizontal plane 81.

As seen in FIG. 3, the upstream-facing surfaces 90 and downstream-facing surfaces 92 of the elongate members 80 extend between the respective outer surfaces 86 and inner surfaces 88 of the elongate members. The upstream-facing surfaces and downstream-facing surfaces of the elongate members 80 are wider than the outer surfaces 86 of the elongate members in this embodiment. The surfaces 86, 88, 90 and 92 of the elongate members extend between the sides 60 and 62 of the assembly 40 seen in FIG. 2.

Figure 5:
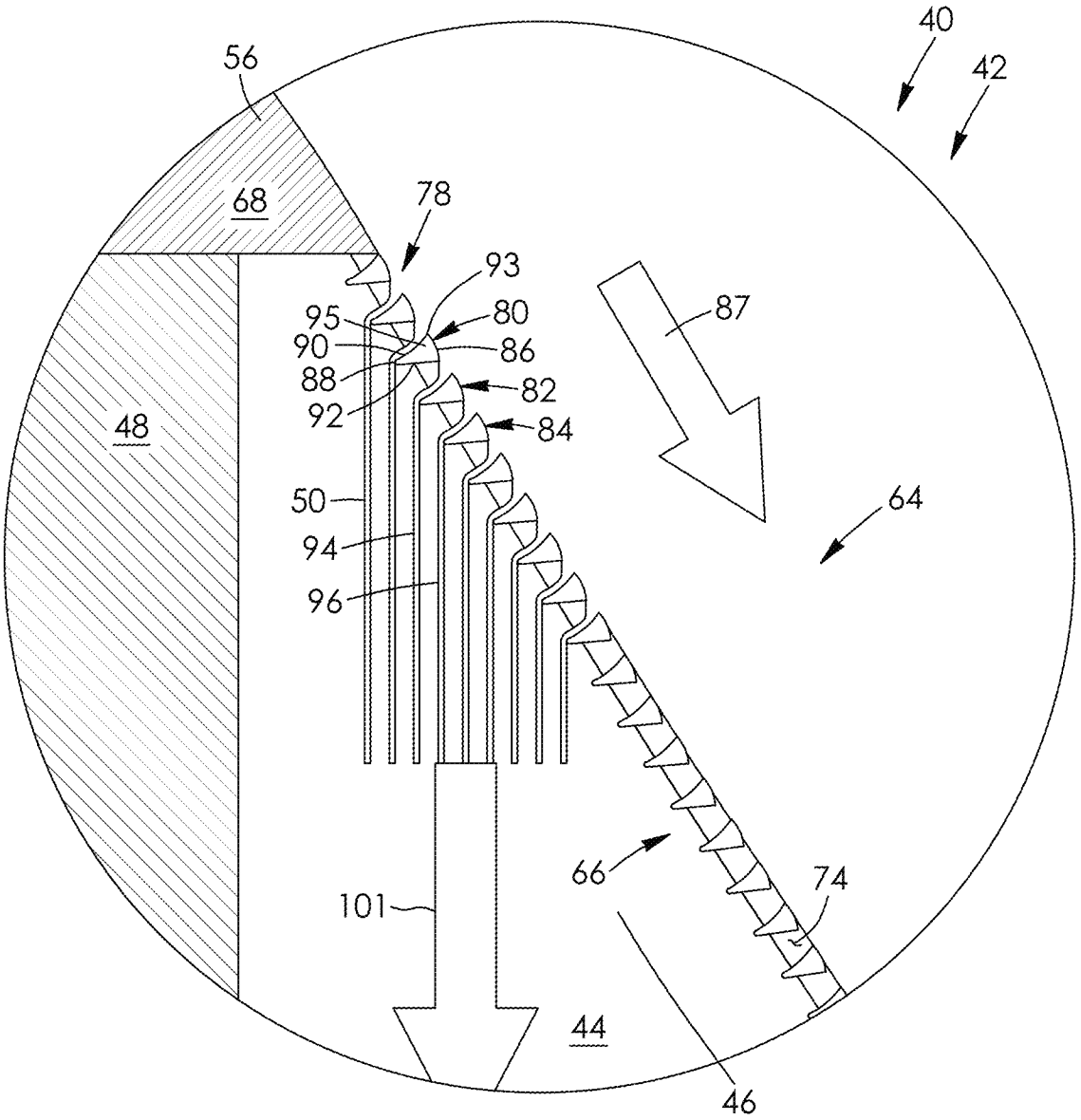
FIG. 5 is a fragmented right side elevation view of the water intake structure of FIG. 1, together with a schematic view of water flowing in part over the structure, with the water being entrained in part through the structure, with the dam and penstock also being shown in fragment.

Referring back to FIG. 3, each elongate member 80 has an upper or leading edge 93 between and adjacent outer surface 86 thereof and upstream-facing surface 90 thereof. Each elongate member includes an upper peripheral portion 95 extending between the outer surface 86 thereof and the upstream-facing surface 90 thereof. The upper peripheral portion of each elongate member is generally triangular in lateral profile and curved in lateral profile at least in part in this embodiment. In this example the upper peripheral portions 95 are outwardly convex in lateral profile in part in this example. Referring to FIG. 5, the upper peripheral portions of the elongate members 80 so shaped may function to direct a flow of water towards an intake direction 101 and towards the inlet 46 of the penstock 44, between adjacent elongate members 80 and 82.

Referring to FIG. 3, each elongate member 80 includes a lower peripheral portion 99 extending between the outer surface 86 thereof and the downstream-facing surface 92 thereof. The lower peripheral portion is sloped relative to the upper peripheral portion 95 of the elongate member in this embodiment. The lower peripheral portion 99 of the elongate member is curved in lateral profile at least in part and in this example is outwardly concave in part in lateral profile. Referring to FIG. 5, the lower peripheral portions of the elongate members so shaped may function to direct a flow of water towards the intake direction 101 and towards the inlet 46 of the penstock 44, between adjacent elongate members 80 and 82, before and instead of hitting the leading edge 97 of the next elongate member 82.

Still referring to FIG. 5, the assembly 40 is positioned to enable water 50 to flow above and along the outer surfaces 86 of the elongate members 80, 82 and 84, as shown by arrow of numeral 87, and to intake portions 94 and 96 of the water between adjacent said elongate members 80 and 82, and 82 and 84. The portions of water abut the upstream-facing surfaces 90 of the elongate members. The elongate members 80, 82 and 84 are positioned to promote the Coandă effect, with portions 94 and 96 of the water 50 being taken in thereby.

As seen in FIG. 3 and in addition without limiting the above, each elongate member 80 thus may be said to have a three-sided cross section, with an upstream-facing side 90, a downstream-facing side 92, and an outer side 86. The upstream-facing side is outwardly concave, with a circular profile having a radius in the range of 20 mm to 200 mm in one preferred example, with the radius being equal to 100 mm according to one preferred embodiment. The downstream-facing side 92 is flat. The outer side 86 is outwardly convex, with a circular profile having a radius in the range of 10 mm to 250 mm, with the radius being equal to 60 mm in one preferred example. However, these ranges and dimensions may not be strictly required and the elongate members 80 may have other sizes in other embodiments, for example.

As seen in FIG. 3, upstream-facing side 90 of the elongate member extends downwards from and relative to outer side 86 of the elongate member by angle $\alpha$. This angle is measured between the tangent directions of the circular profiles of the upstream-facing side 90 and the outer side 86. Angle $\alpha$ is in the range of 20 degrees to 110 degrees in one preferred example, with the angle $\alpha$ being equal to 65 degrees according to one preferred embodiment. However, these angles may not be strictly required and may have other values in other embodiments, for example. The leading edge 93 of the elongate member is sharp to promote and improve flow of water thereon and therepast. Rearward edge 89 and trailing edge 91 of the elongate member 80 may be sharp or slightly rounded.

As seen in FIG. 5, the elongate members are arranged in a repeating pattern, with the outer side 86 of each elongate member roughly parallel to the flow of water 50 over the screen assembly 40 as indicated by arrow 87.

Referring back to FIG. 4, the assembly 40 includes a plurality of slots interposed between respective pairs of elongate members, as seen by slot 103 in FIG. 4. Each slot has a width $W_S$ is in the range of 0.1 mm to 10 mm in one preferred example, with the slot width being equal to 1.5 mm according to one preferred embodiment. However, these ranges and dimensions may not be strictly required and may be equal to other values in other embodiments, for example. Referring to FIG. 5, as water flows over the elongate members, surface tension effects cause the water stream to cling to the rounded outer side 86 of the elongate member and turn towards the slot between the elongate members.

Figure 6:
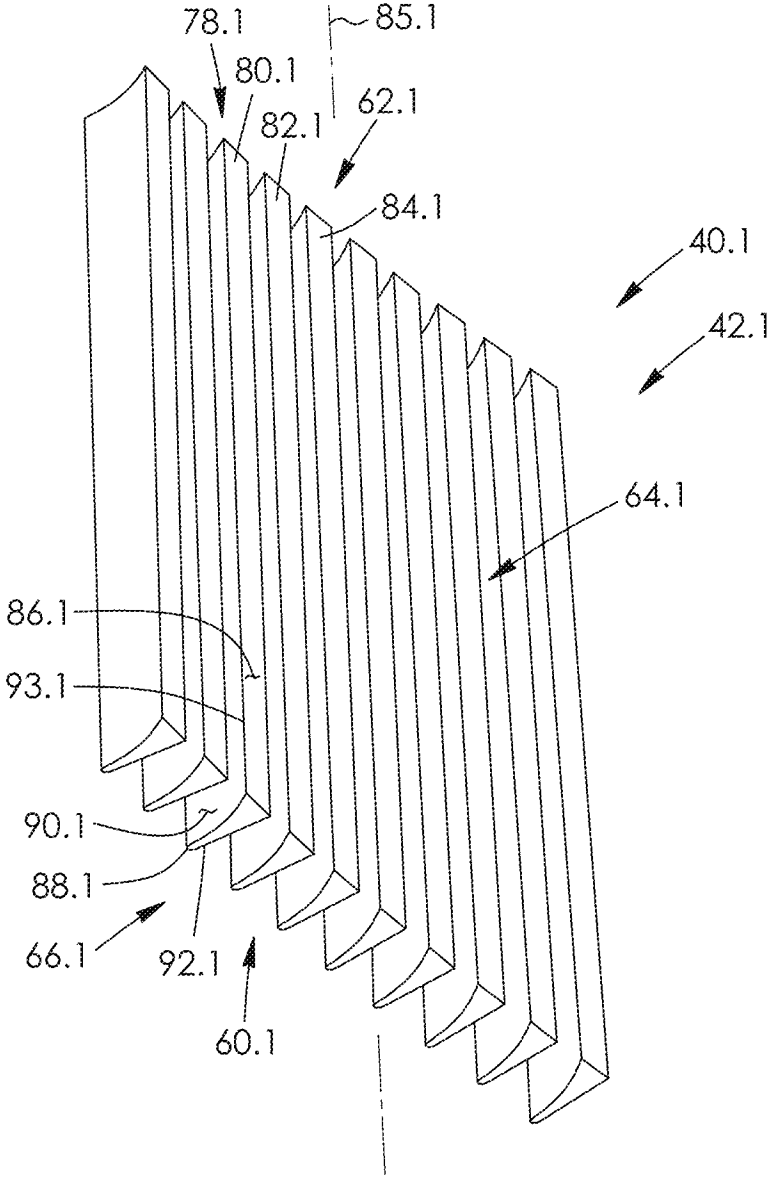
FIG. 6 is a top, right side, front perspective view of elongate members of a water intake structure of a hydropower plant according to a second embodiment.
Figure 7:
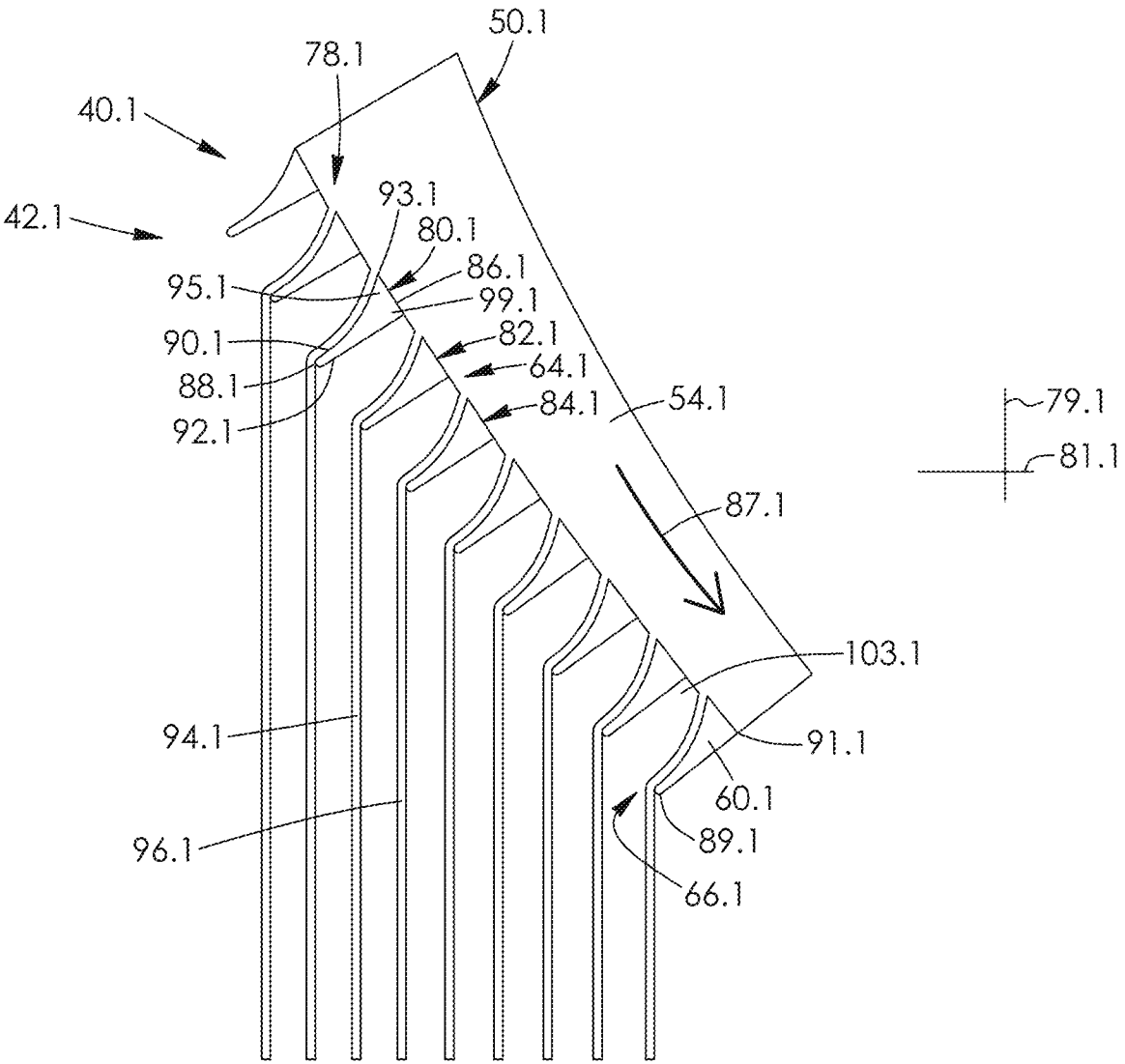
FIG. 7 is a right side elevation view of the elongate members of FIG. 6, together with a schematic view of water flowing in part over the elongate members and being entrained in part through the elongate members.

FIGS. 6 to 7 show a water intake structure, in this example a Coandă screen assembly 40.1 for a hydropower plant 42.1 according to a second embodiment. Like parts have like numbers and functionings as the embodiment shown in FIGS. 1 to 5 with the addition of decimal extension ".1". Assembly 40.1 and hydropower plant 42.1 are substantially the same as assembly 40 and hydropower plant 42 shown in FIGS. 1 to 5 with the following exceptions.

Each elongate member, in this example elongate member 80.1 has first and second exterior surfaces, in this case an outer surface 86.1 thereof and a downstream-facing surface 92.1 thereof which are both planar in this embodiment. The outer surface of each elongate member extends perpendicular with respect to the downstream-facing surface of the elongate member in this example.

As seen in FIG. 7, the outer surfaces 86.1 and downstream-facing surfaces 92.1 of the elongate members 80.1 are sloped in this example relative to the vertical plane 79.1 and horizontal plane 81.1. The outer surfaces of the elongate members are positioned to extend in parallel with the flow of water 50.1 thereon, with said flow being shown by arrow 87.1. Each elongate member 80.1 has a third exterior surface, in this example an upstream-facing surface 90.1 which is outwardly concave in lateral profile. The upper peripheral portions 95.1 of the elongate members are curved in lateral profile at least in part and in this example are outwardly concave in lateral profile in part.

Figure 8:
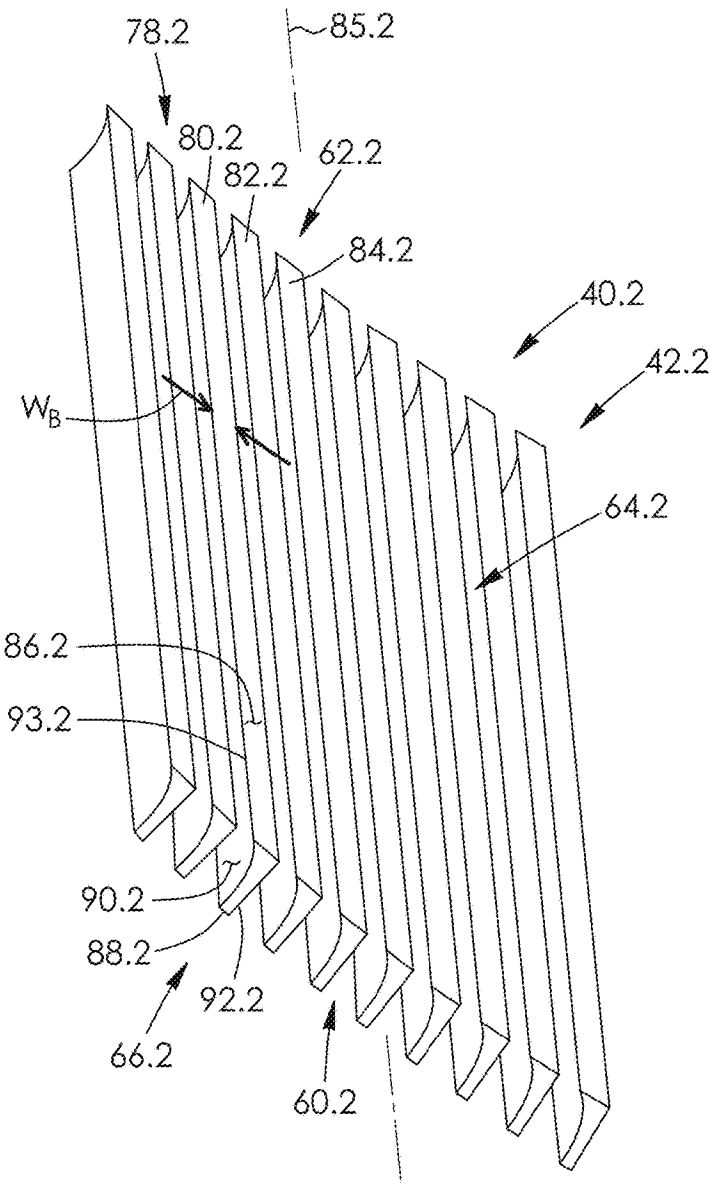
FIG. 8 is a top, right side, front perspective view of elongate members of a water intake structure of a hydropower plant according to a third embodiment.
Figure 9:
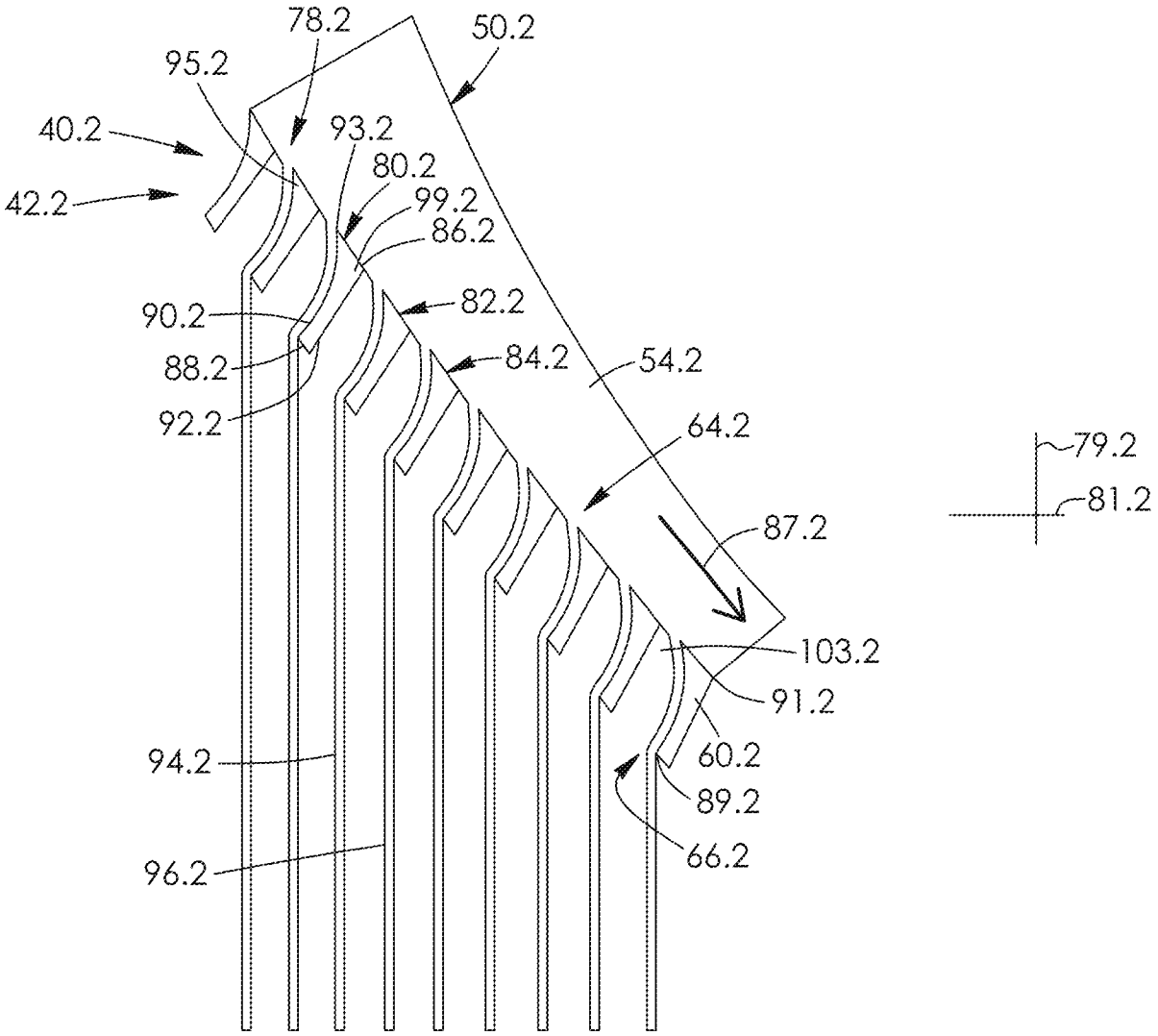
FIG. 9 is a right side elevation view of the elongate members of FIG. 8, together with a schematic view of water flowing in part over the elongate members and being entrained in part through the elongate members.

FIGS. 8 to 9 show a water intake structure, in this example a Coandă screen assembly 40.2 for a hydropower plant 42.2 according to a third embodiment. Like parts have like numbers and functionings as the embodiment shown in FIGS. 1 to 5 with the addition of decimal extension ".2". Assembly 40.2 and hydropower plant 42.2 are substantially the same as assembly 40 and hydropower plant 42 shown in FIGS. 1 to 5 with the following exceptions.

Each elongate member, in this example elongate member 80.2 is trapezoidal in lateral cross-section in this embodiment. The outer surfaces 86.2 of the elongate members extend in parallel with the respective inner surfaces 88.2 of the elongate members in this example. Referring to FIG. 9, the outer surfaces of the elongate members are positioned to extend in parallel with the flow of water 50.2 thereon, with said flow being shown by arrow 87.2. The downstream-facing surfaces 92.2 of the elongate members 80.2 are planar in this embodiment.

As seen in FIG. 9, the outer surfaces 86.2, inner surfaces 88.2 and downstream-facing surfaces of the elongate members are sloped in this example relative to the vertical plan 79.2 and horizontal plane 81.2. Referring to FIG. 8, each outer surface 86.2 of the elongate members 80.2 has a width $W_B$. The inner surfaces 88.2 of the elongate members have widths that are equal to or less than $0.5 \times W_B$ in this embodiment. Each elongate member 80.2 has an upstream-facing surface 90.2 that is outwardly concave in this embodiment. As seen in FIG. 9, the upper peripheral portions 95.2 of the elongate members are curved in lateral profile at least in part and are outwardly concave in lateral profile in part in this example.

Figure 10:
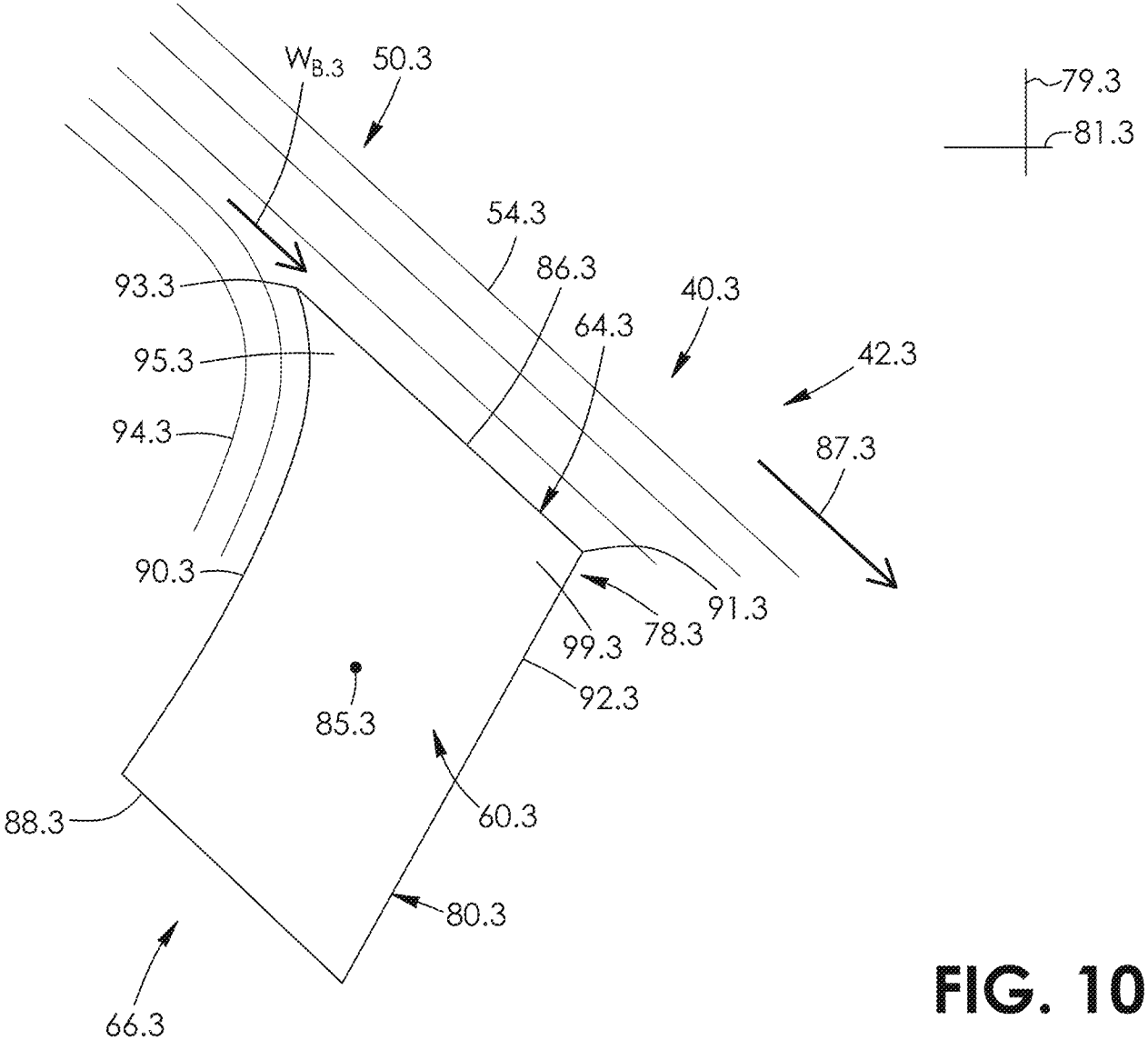
FIG. 10 is a right side elevation view of one of a plurality of elongate members of a water intake structure of a hydropower plant according to a fourth embodiment, together with a schematic view of water flowing in part over an outer surface of the elongate member, with the water being entrained in part and abutting against an upstream-facing surface of the elongate member.

FIG. 10 shows one of a plurality of elongate members 80.3 of a water intake structure, in this example a Coandă screen assembly 40.3 for a hydropower plant 42.3 according to a fourth embodiment. Like parts have like numbers and functionings as the embodiment shown in FIGS. 8 to 9 with the replacement of decimal extension ".2" with decimal extension ".3" and with the addition of decimal extension ".3" for parts not previously having decimal extensions. Assembly 40.3 and hydropower plant 42.3 are substantially the same as assembly 40.2 and hydropower plant 42.2 shown in FIGS. 8 to 9 with the following exception.

The outer surfaces 86.3 of the elongate members, in this example elongate members 80.3, have widths $W_{B.3}$ and inner surfaces 88.3 of the elongate members have widths that are equal to or less than $0.75 \times W_{B.3}$ in this embodiment. The outer surfaces are positioned to extend in parallel with the flow of water 50.3 thereon, with said flow being shown by arrow 87.3. The upper peripheral portions 95.3 of the elongate members 80.3 are curved in lateral profile at least in part and in this example are outwardly concave in lateral profile in part.

Figure 11:
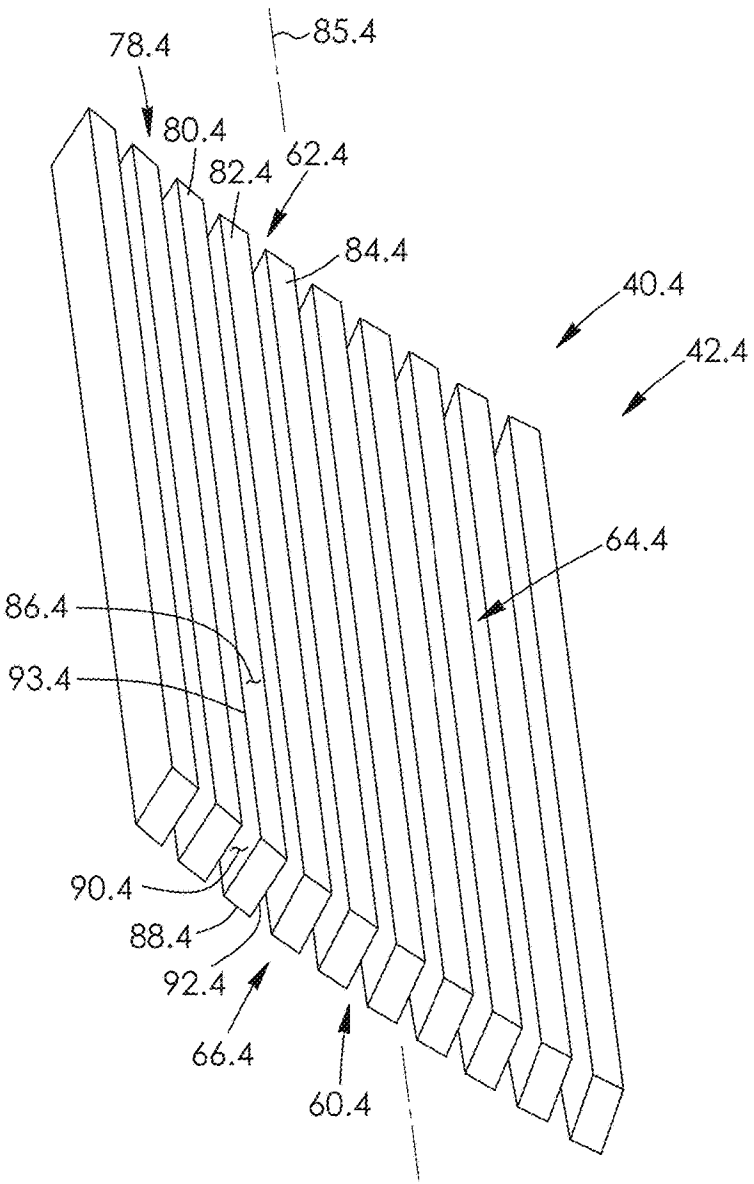
FIG. 11 is a top, right side, front perspective view of elongate members of a water intake structure of a hydropower plant according to a fifth embodiment.
Figure 12:
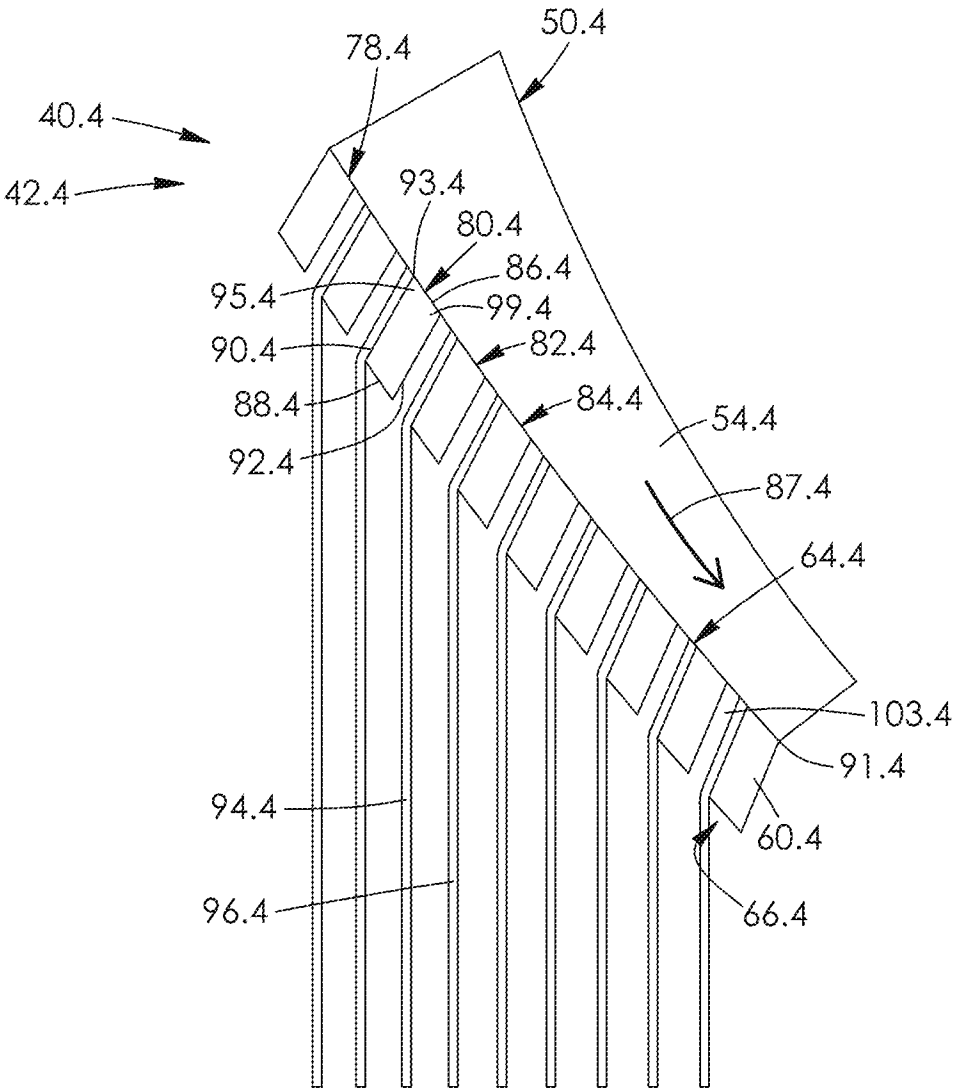
FIG. 12 is a right side elevation view of the elongate members of FIG. 11, together with a schematic view of water flowing in part over the elongate members and being entrained in part through the elongate members.
Figure 13:
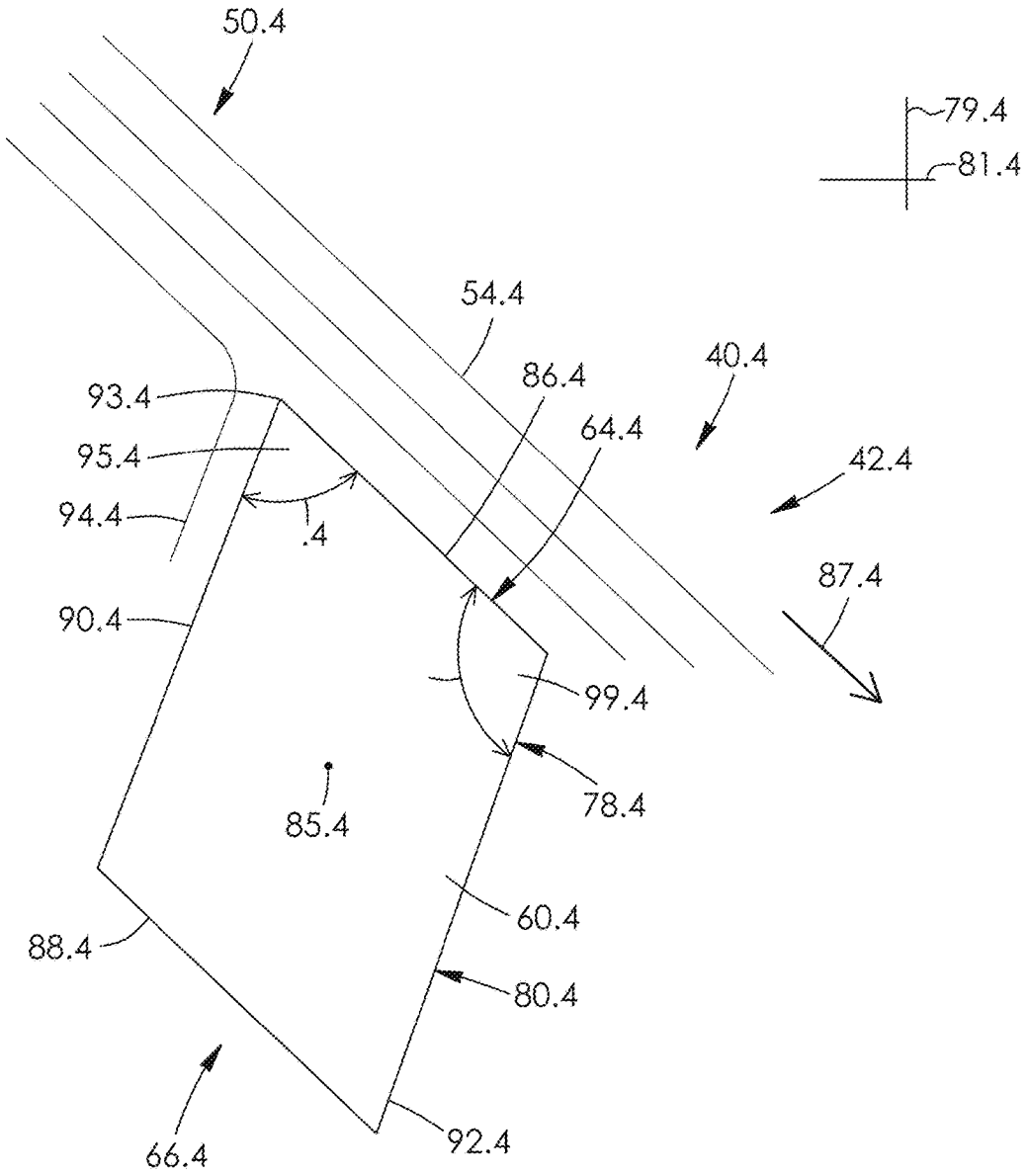
FIG. 13 is a right side elevation view of one of the elongate members of FIG. 12, together with a schematic view of water flowing in part over an outer surface of the elongate member and being entrained in part and abutting against an upstream-facing surface of the elongate member.

FIGS. 11 to 13 show a water intake structure, in this example a Coandă screen assembly 40.4 for a hydropower plant 42.4 according to a fifth embodiment. Like parts have like numbers and functionings as the embodiment shown in FIGS. 8 to 9 with the replacement of decimal extension ".2" with decimal extension ".4" and with the addition of decimal extension ".4" for parts not previously having decimal extensions. Assembly 40.4 and hydropower plant 42.4 are substantially the same as assembly 40.2 and hydropower plant 42.2 shown in FIGS. 8 to 9 with the following exception.

As seen in FIG. 13, each of the elongate members, in this example elongate member 80.4, has exterior surfaces 86.4, 88.4, 90.4 and 92.4 which form a parallelogram in shape in lateral cross-section in this embodiment. Each of the exterior surfaces of the elongate members is planar in this embodiment. Downstream-facing surface 92.4 extends parallel to upstream-facing surface 90.4 and outer surface 86.4 extends parallel to inner surface 88.4 of the elongate member in this embodiment. The outer surfaces 86.4 are positioned to extend in parallel with the flow of water 50.4 thereon, with said flow being shown by arrow 87.4.

Still referring to FIG. 13, upstream-facing surface 90.4 of elongate member 80.4 extends downwards from the outer surface 86.4 of the elongate member at an acute angle $\alpha.4$ relative to the outer surface. Angle $\alpha.4$ is equal to 70 degrees in this example; however this is not strictly required and the angle may be different in other embodiments. Downstream-facing surface 92.4 of the elongate member extends from the outer surface 86.4 of the elongate member at an obtuse angle β relative to the outer surface. Angle β is equal to 110 degrees in this example; however this is not strictly required and this angle may be different in other embodiments.

Figure 14:
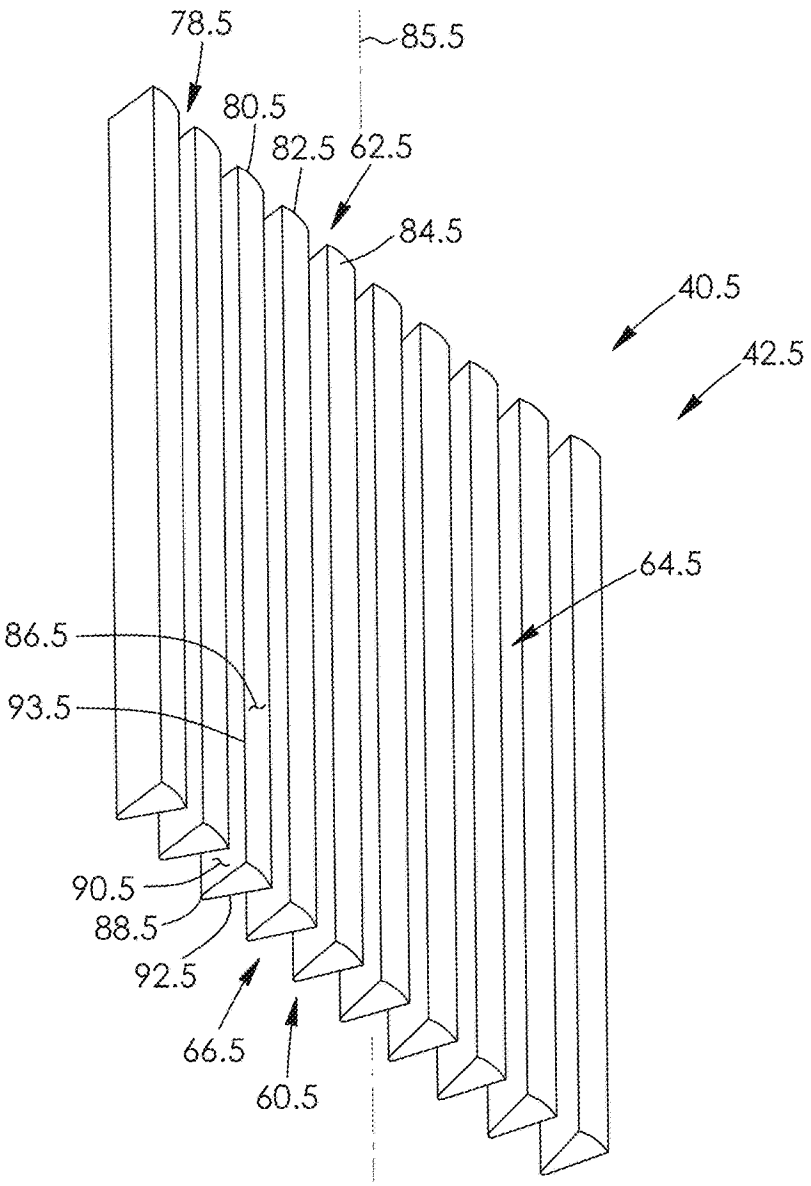
FIG. 14 is a top, right side, front perspective view of elongate members of a water intake structure of a hydropower plant according to a sixth embodiment.
Figure 15:
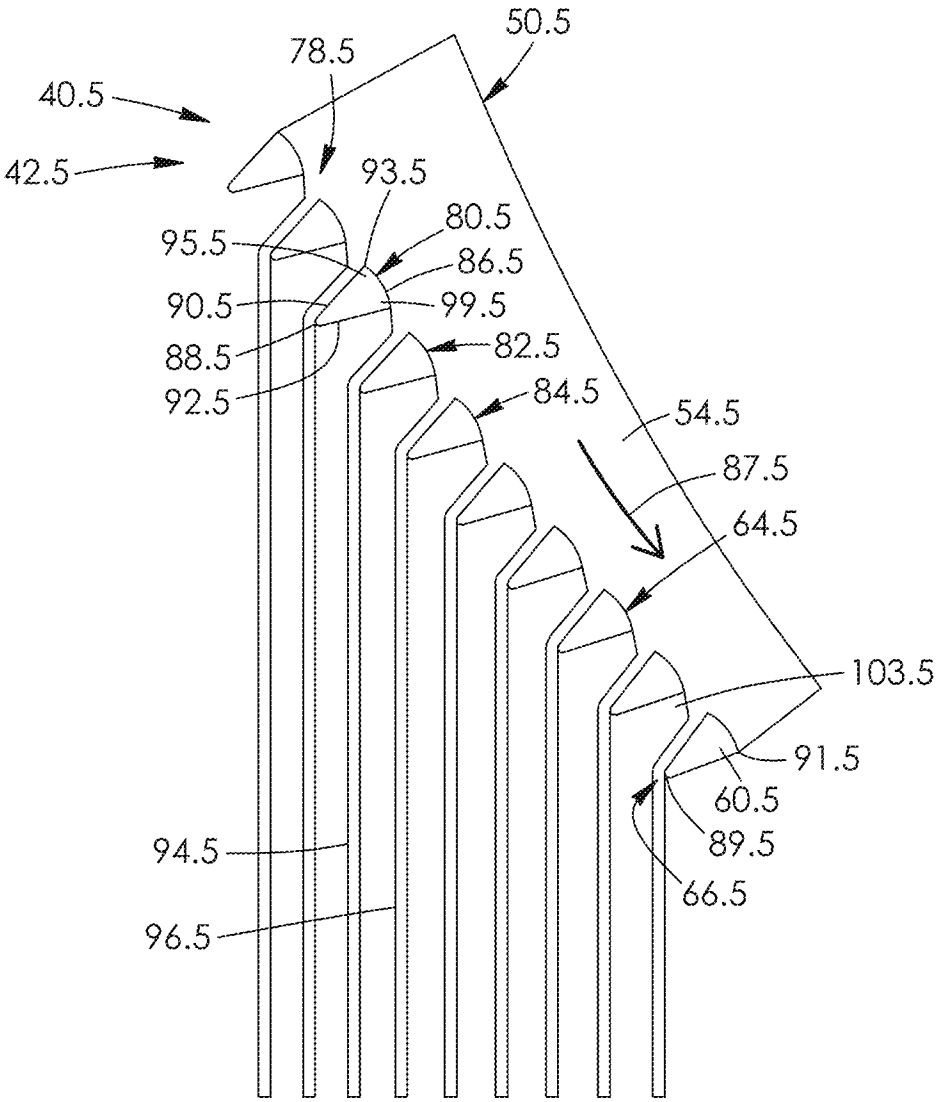
FIG. 15 is a right side elevation view of the elongate members of FIG. 14, together with a schematic view of water flowing in part over the elongate members and being entrained in part through the elongate members.
Figure 16:
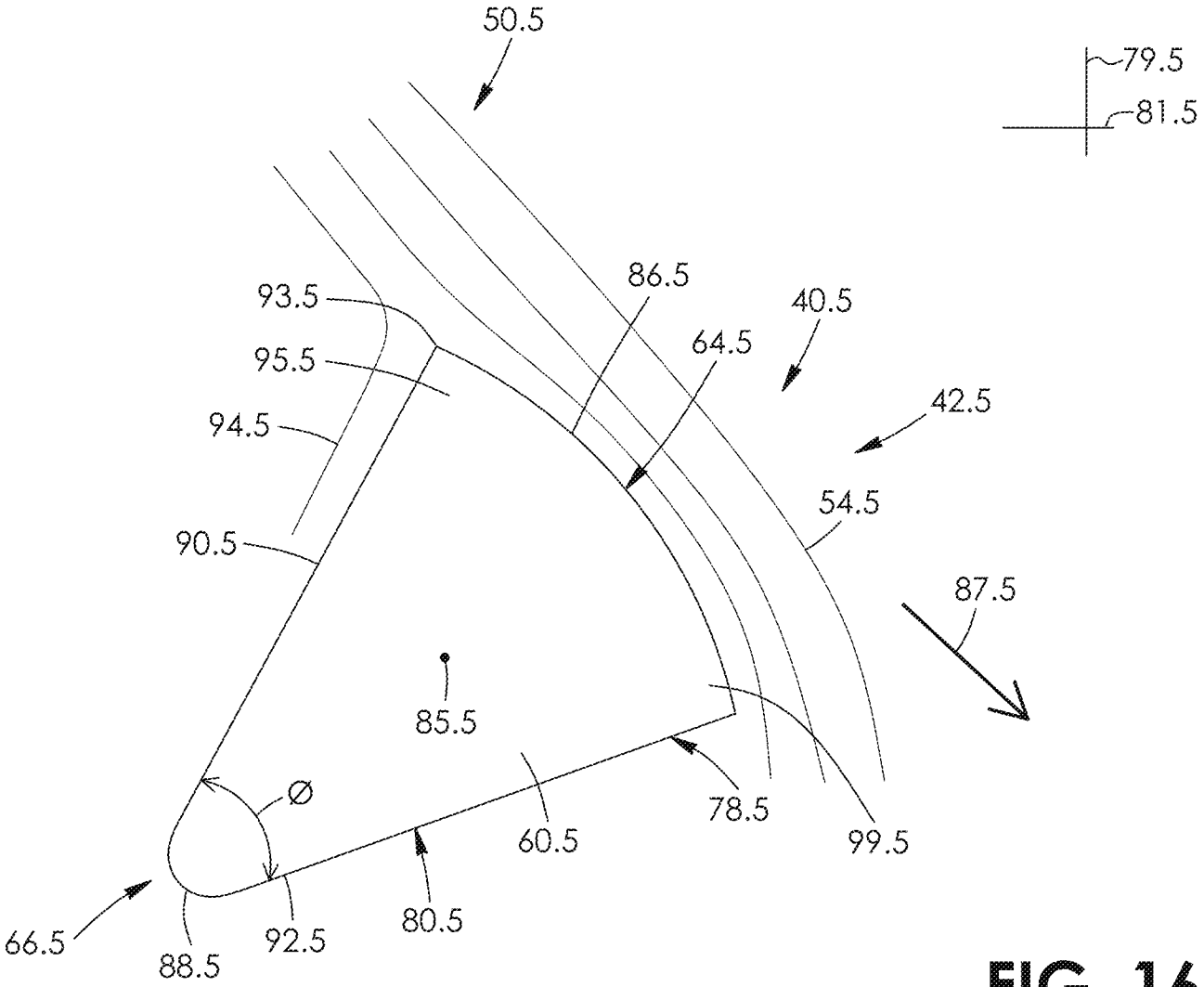
FIG. 16 is a right side elevation view of one of the elongate members of FIG. 15, together with a schematic view of water flowing in part over an outer surface of the elongate member, with the water being entrained in part and abutting against an upstream-facing surface of the elongate member.

FIGS. 14 to 16 show a water intake structure, in this example a Coandă screen assembly 40.5 for a hydropower plant 42.5 according to a sixth embodiment. Like parts have like numbers and functionings as the embodiment shown in FIGS. 1 to 5 with the addition of decimal extension ".5". Assembly 40.5 and hydropower plant 42.5 are substantially the same as assembly 40 and hydropower plant 42 shown in FIGS. 1 to 5 with the following exceptions.

Each elongate member, in this example elongate member 80.5 is generally wedge-shaped in lateral cross-section. Referring to FIG. 16, each elongate member has first and second exterior surfaces, in this example upstream-facing surface 90.5 and downstream-facing surface 92.5, which are planar. The upstream-facing surface extends upwards from the downstream-facing surface at an acute angle ϕ relative to the downstream-facing surface. Angle ϕ is equal to 40 degrees in this example; however this is not strictly required and the angle may be different in other embodiments.

Each elongate member 80.5 has a third exterior surface, in this example an outer surface 86.5 which is outwardly convex.

Still referring to FIG. 16, the upper peripheral portions 95.5 of the elongate members are curved in lateral profile at least in part and in this example are outwardly convex in part in lateral profile. The lower peripheral portions 99.5 are of the elongate members 80.5 are sloped relative to the corresponding upper peripheral portions of the elongate members in this embodiment. The lower peripheral portions 99.5 of the elongate members are curved in lateral profile at least in part and in this example are outwardly convex in part in lateral profile.

Figure 17:
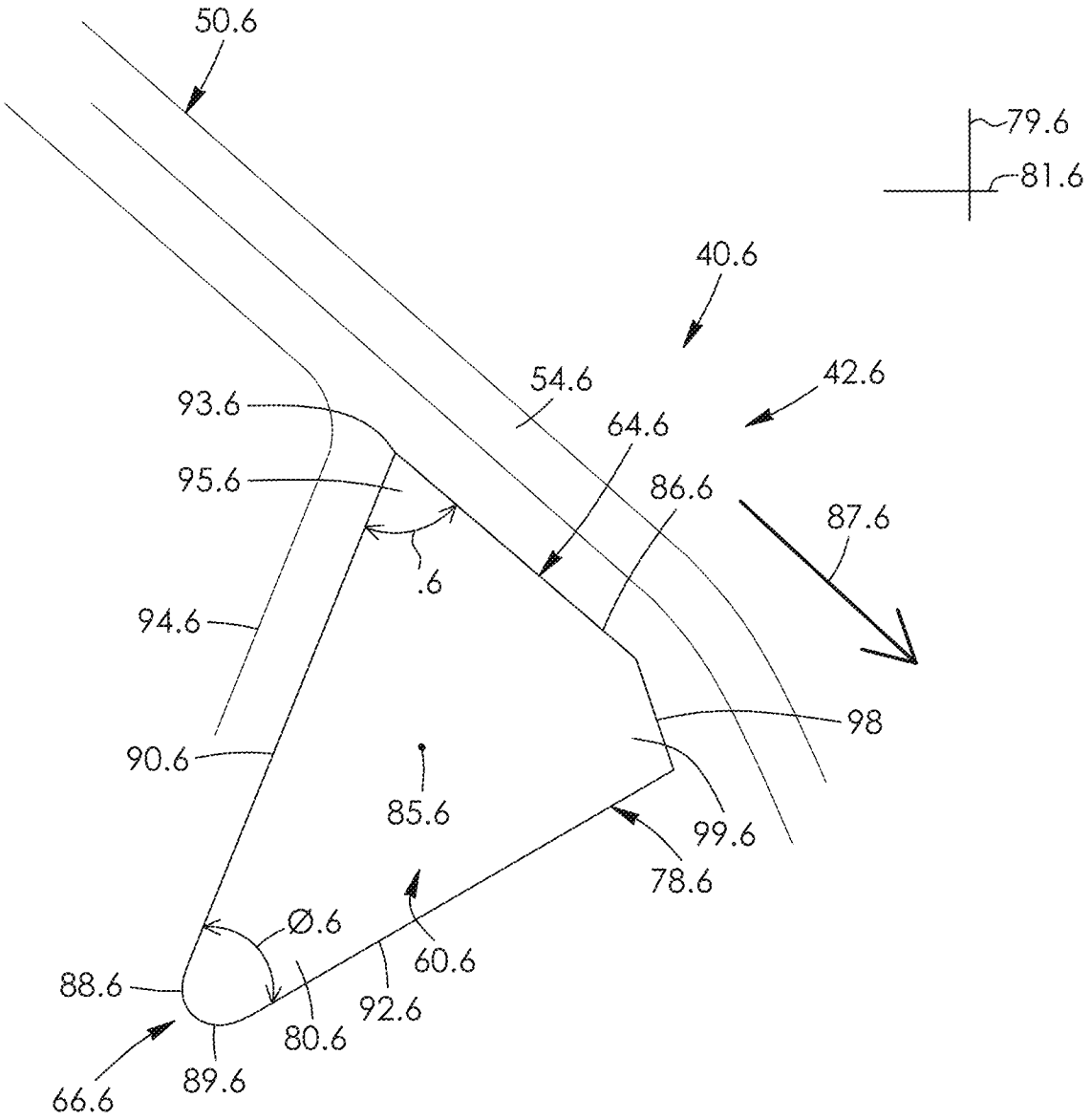
FIG. 17 is a right side elevation view of one of a plurality of elongate members of a water intake structure of a hydropower plant according to a seventh embodiment, together with a schematic view of water flowing in part over an outer surface of the elongate member, with the water being entrained in part and abutting against an upstream-facing surface of the elongate member.

FIG. 17 shows one of a plurality of elongate members 80.6 of a water intake structure, in this example a Coandă screen assembly 40.6 for a hydropower plant 42.6 according to a seventh embodiment. Like parts have like numbers and functionings as the embodiment shown in FIGS. 14 to 16 with the replacement of decimal extension ".5" with decimal extension ".6" and with the addition of decimal extension ".6" for parts not previously having decimal extensions. Assembly 40.6 and hydropower plant 42.6 are substantially the same as assembly 40.5 and hydropower plant 42.5 shown in FIGS. 14 to 16 with the following exception.

Each elongate member, in this example elongate member 80.6 is generally wedge-shaped in lateral cross-section. Each elongate member has an upper outer surface 86.6 adjacent to the upstream-facing surface 90.6 thereof. The upper outer surface is positioned to extend in parallel with the flow of water 50.6 thereon, with said flow being shown by arrow 87.6. Each elongate member 80.6 has a beveled edge, in this example a lower outer surface 98 extending between the upper outer surface 86.6 thereof and a downstream-facing surface 92.6 thereof. The lower outer surface 98 is thus adjacent to the downstream-facing surface 92.6 of the elongate member and is sloped relative to the upper outer surface 86.6 of the elongate member. Each elongate member 80.6 in this embodiment thus has a downstream beveled edge.

The upstream-facing surface 90.6 of each elongate member extends downwards from upper outer surface 86.6 of the elongate member at an acute angle α.6 relative to the upper outer surface 86.6 of the elongate member. The upstream-facing surface 90.6 of each elongate member 80.6 extends upwards from the downstream-facing surface 92.6 of the elongate member at an acute angle ϕ.6 relative to the downstream-facing surface in this example. The lower peripheral portions 99.6 of the elongate members 80.6 are sloped relative to the upper peripheral portions 95.6 of the elongate members in this embodiment.

FIGS. 18 to 21 show a water intake structure, in this example a Coandă screen assembly 40.7 for a hydropower plant 42.7 according to an eighth embodiment. Like parts have like numbers and functionings as the embodiment shown in FIGS. 1 to 5 with the addition of decimal extension ".7". Assembly 40.7 and hydropower plant 42.7 are substantially the same as assembly 40 and hydropower plant 42 shown in FIGS. 1 to 5 with the following exceptions.

Figures 18, 19:
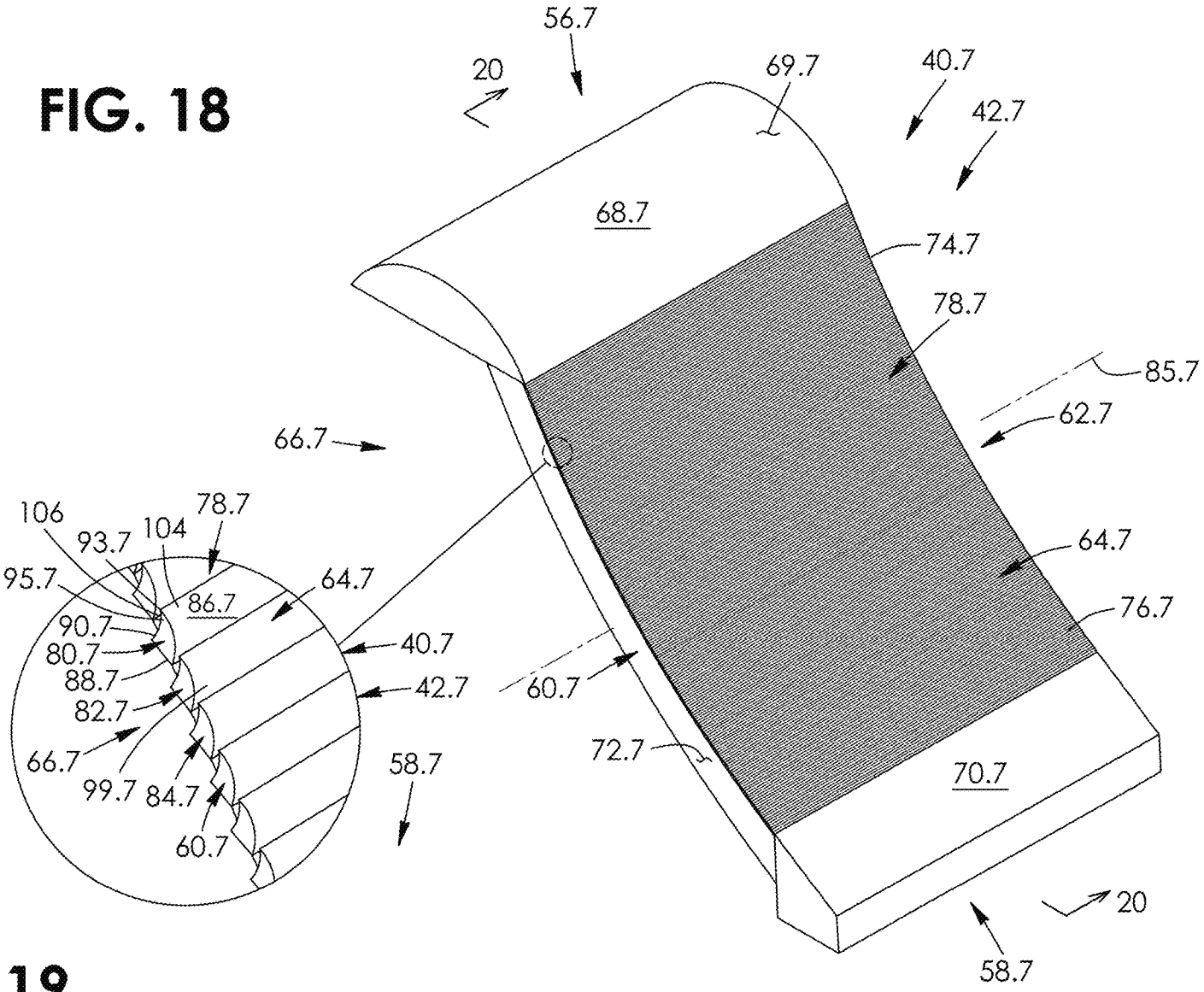
FIG. 18 is a top, right side, front perspective view of a water intake structure of a hydropower plant according to an eighth embodiment, the water intake structure including a plurality of elongate members.
FIG. 19 is an enlarged top, right side, front perspective view of some of the elongate members of the water intake structure of FIG. 18.

As seen in FIG. 19, each elongate member, in this example elongate member 80.7 has an outer surface 86.7 that is outwardly convex in lateral profile. The outer surfaces face towards the front 64.7 of the assembly 40.7 in part and face towards the bottom 58.7 of the assembly in part in this example.

Each elongate member 80.7 has an upstream-facing surface 90.7 that is outwardly concave in lateral profile in this embodiment. The outer surfaces 86.7 of the elongate members are wider than the upstream-facing surfaces of the elongate members and are wider than that the inner surfaces 88.7 of the elongate members in this example.

Figures 20, 21:
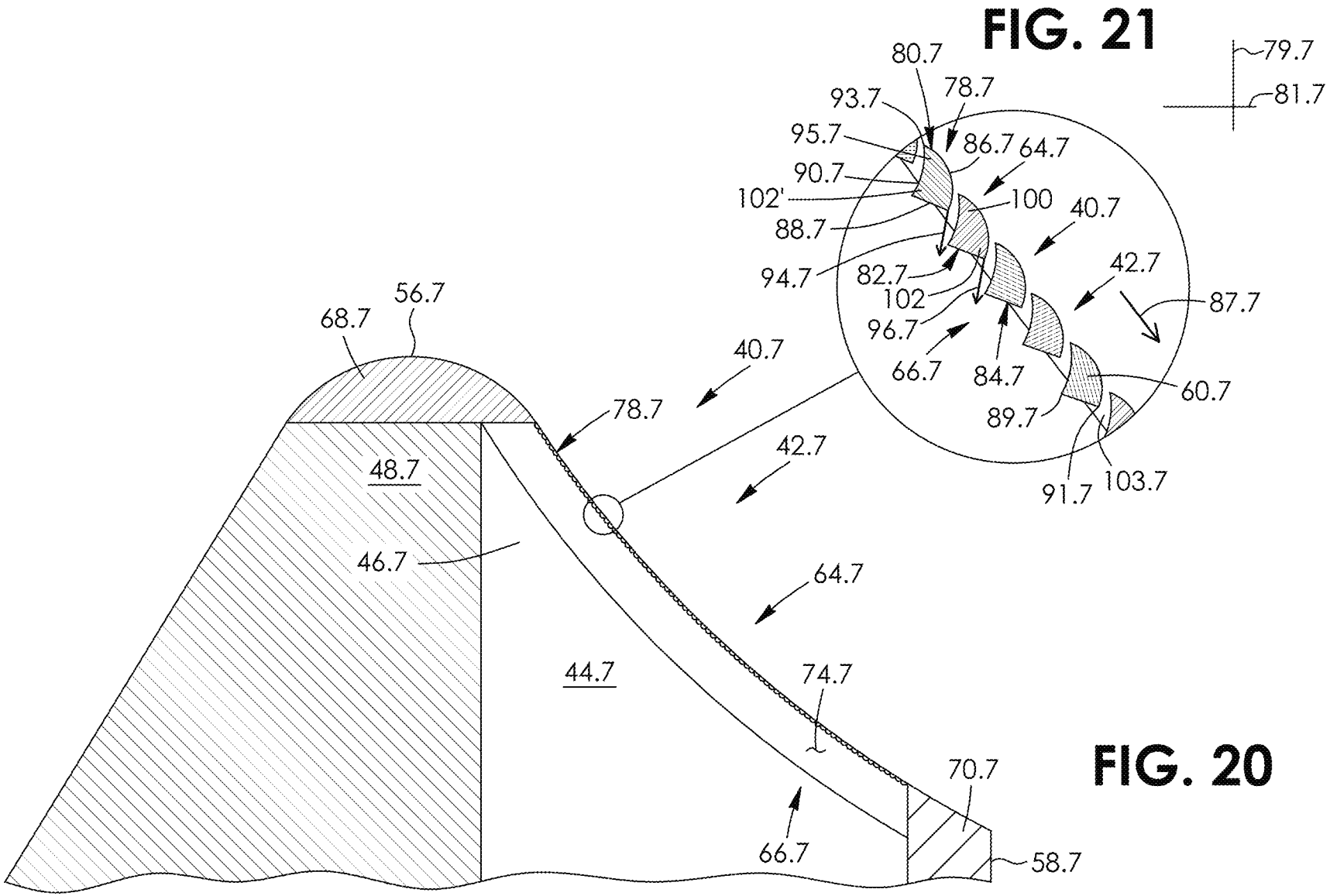
FIG. 20 is a sectional view taken along lines 20-20 of the water intake structure of FIG. 18, together with a dam and penstock, both shown in fragment, of a hydropower plant of which the water intake structure is a part.
FIG. 21 is an enlarged sectional elevation view of some of the elongate members of the water intake structure of FIG. 20.

As seen in FIG. 21, the inner surfaces of the elongate members 80.7 are planar and sloped relative to the vertical plane 79.7 and horizontal plane 81.7.

Still referring to FIG. 21, each elongate member 82.7 includes a top portion 100 and a bottom portion 102. The top portion 100 of elongate member 82.7 is adjacent to the bottom portion 102' of an adjacent elongate member 80.7.

As seen in FIG. 19, the upper peripheral portions 95.7 of the elongate members 80.7 are curved in lateral profile at least in part, outwardly convex in an upper section 104 thereof and outwardly concave in a lower section 106 thereof. The lower peripheral portions 99.7 of the elongate members are sloped relative to the upper peripheral portion 95.7 of the elongate members in this embodiment. The lower peripheral portions of the elongate members are curved in lateral profile at least in part and in this example are outwardly convex in lateral profile in part.

FIGS. 22 to 25 show a water intake structure, in this example a Coandă screen assembly 40.8 for a hydropower plant 42.8 according to a ninth embodiment. Like parts have like numbers and functionings as the embodiment shown in FIGS. 18 to 21 with decimal extension ".8" replacing decimal extension ".7" and being added for parts not previously having decimal extensions. Assembly 40.8 and hydropower plant 42.8 are substantially the same as assembly 40.7 and hydropower plant 42.7 shown in FIGS. 1 to 18 to 21 with the following exceptions.

Figure 22:
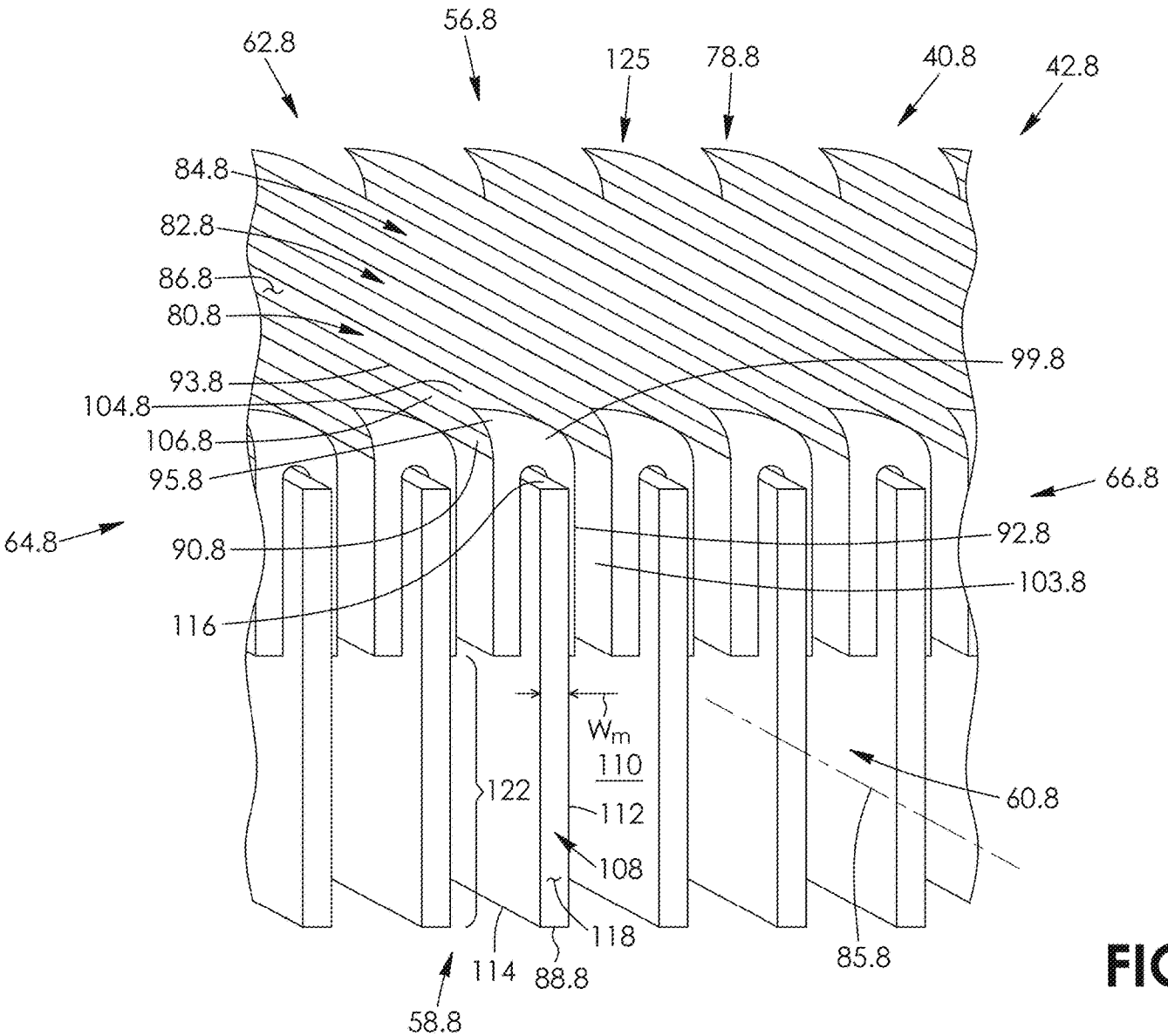
FIG. 22 is a right side, front, top perspective view of a plurality of elongate members of a water intake structure of a hydropower plant according to a ninth embodiment, with some of the elongate members being shown in fragment in part.

As seen in FIG. 22, each elongate member 80.8 of the assembly includes an inner portion, in this example an elongate mount 108 that is rigid. The mounts in this example are made of metal, in this case steel plate; however, this is not strictly required and the mounts of the elongate members may be made of other rigid materials in other examples.

The mounts are planar and in the form of rectangular prisms in this example. Each mount 108 has an upstream-facing surface 110 and a downstream-facing surface 112 each of which is planar, substantially similar in size and rectangular in this example. Each mount has a rear 114 which aligns with the inner surface 88.8 of the elongate member 80.8 and which is adjacent bottom 58.8 of the assembly 40.8. Each mount 108 has a front 116 spaced-apart from the rear thereof. The upstream-facing surface 110 and downstream-facing surface 112 extend between the front and rear of the mount. The front and rear of the mount are substantially the same in shape in this example.

Each mount 108 includes a pair of sides, as seen by side 118 in FIG. 22, which extend between the rear 114 and front 116 thereof. The rear 114, front 116 and sides 118 of the mount each have widths $W_M$ that are substantially the same in this example.

Figure 23:
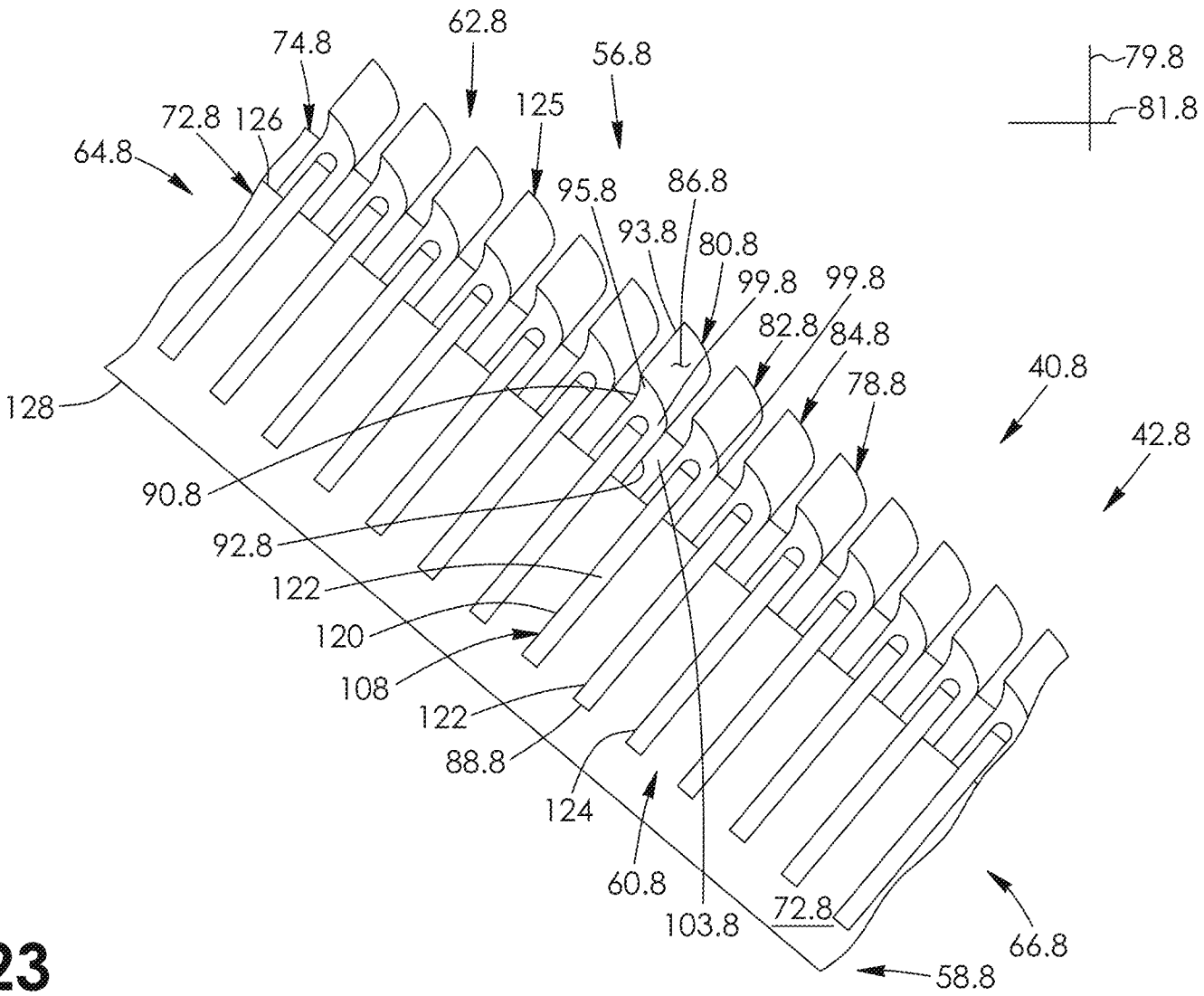
FIG. 23 is a front, top perspective view of the elongate members of the water intake structure of FIG. 22, with siding framing of the water intake structure also being shown.

As seen in FIG. 23, the assembly 40.8 includes one or more supports, in this example structural beams 72.8 and 74.8. At least one beam 72.8 has a plurality of longitudinally spaced-apart grooves 120, 122 and 124 extending therein from the front or top 126 thereof towards the rear or bottom 128 thereof.

Each elongate member 80.8 is selectively received within a respective said groove 120 via first or bottom portion 122 of mount 108. The side framing is thus slotted to hold the elongate members in place. The assembly 40.8 so configured enables selective replacement of only those parts thereof, in this case selective elongate members 80.8 that wear more significantly over time instead of requiring replacement of the assembly as a whole.

As seen in FIG. 22, each elongate member 80.8 includes an outer portion, in this example an elongate outer cap 125 along and upon which water flows. The outer caps are made of an elastomer, in this example rubber, which may provide improved abrasion resistance and be relatively less expensive to manufacture compared to steel for the custom shape of the outer caps. However, this is not strictly required and the outer caps may be made of other materials and be arranged in other configurations in other embodiments.

Figure 24:
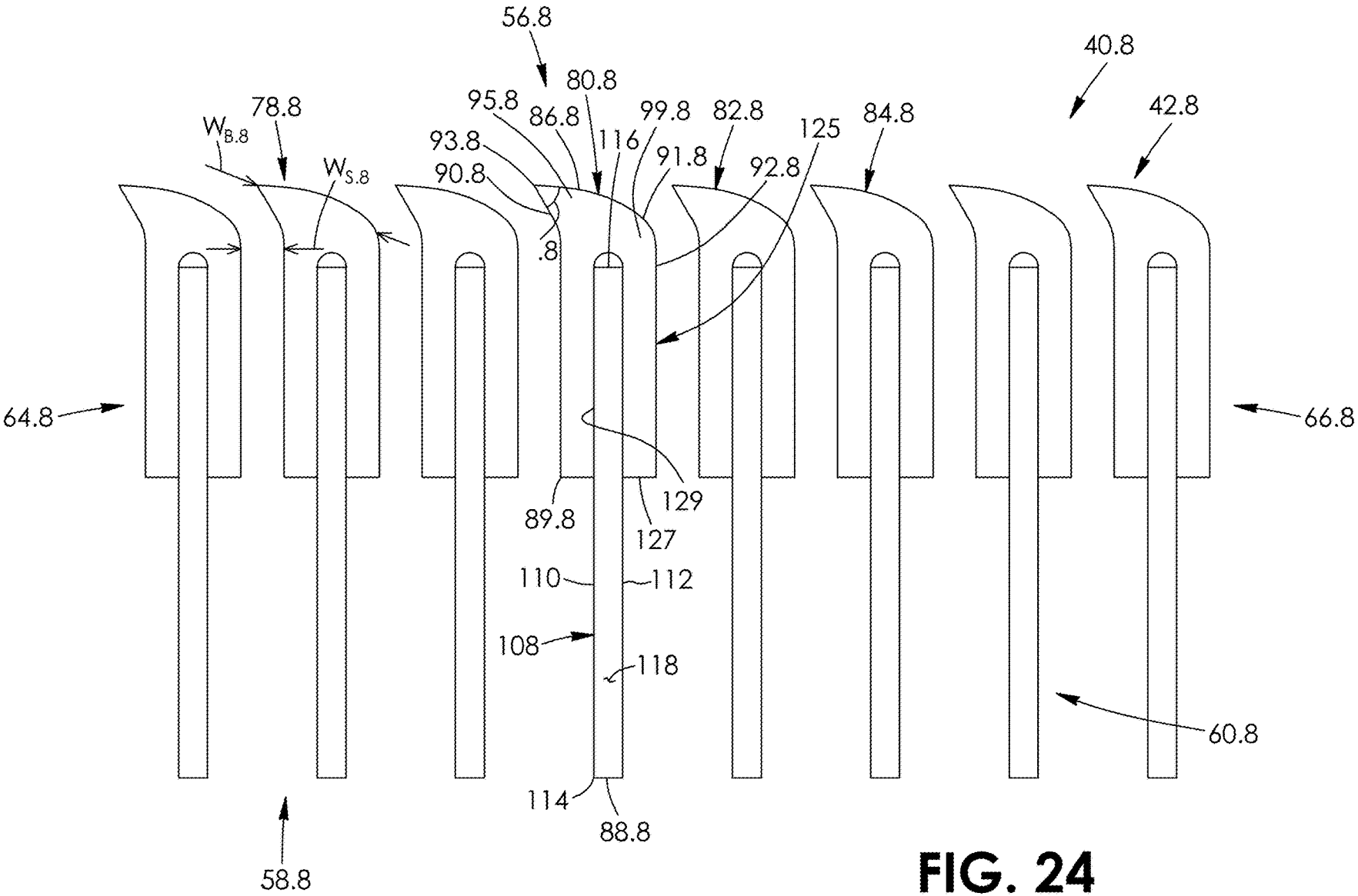
FIG. 24 is a right side elevation view of the elongate members of FIG. 22, with some of the elongate members being shown in fragment.

As seen in FIG. 24, each cap 125 has a rear or inner surface 127 and a groove 129 which extends from the inner surface towards the outer surface 86.8 of the elongate member 80.8.

Alternatively, the outer cap may be made of other polymers, such as a thermoplastic polymer, for example high-density polyethylene (HDPE), which may provide a similar wear performance to steel but with a significant cost saving compared to steel. A further alternatively is to have each elongate member comprise a single integrated and unitary whole, such as an elongate member wholly made of steel.

Figure 25:
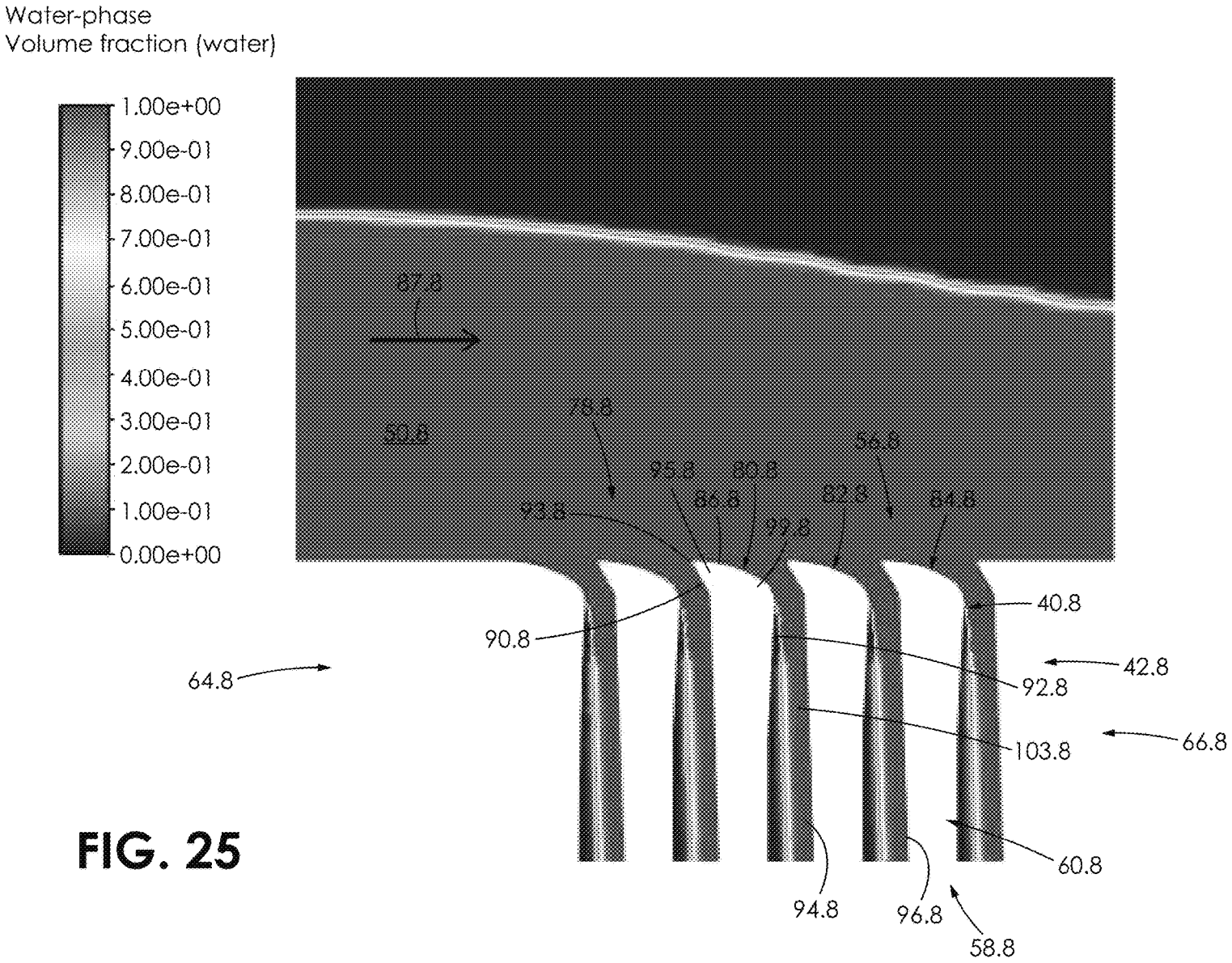
FIG. 25 is a computer modeling diagram showing water flowing in part over outer surfaces of the elongate members of the water intake structure of FIG. 22, with the water being entrained in part and abutting in part against an upstream-facing surface of the elongate members.

Referring to FIG. 25, each elongate member 80.8 has an outer surface 86.8 with a streamlined shape shaped to gradually alter a path 87.8 of water 50.8 extending therealong. The outer surfaces of the elongate members are shaped to promote development of a boundary layer of water thereon and inhibit creation of eddies thereon. As seen in FIG. 22, the outer surfaces 86.8 of the elongate members 80.8 are curved at least in part and in this example are outwardly convex.

As seen in FIG. 24, the upstream-facing surfaces 90.8 of the elongate are curved at least in part and in this example are outwardly concave in part. The outer surface and the upstream-facing surface of each elongate member are thus both curved at least in part in this embodiment. The upstream-facing surface extends downwards from the outer surface 86.8 thereof at an acute angle $\alpha$.8 relative to the outer surface thereof. The upper peripheral portion 95.8 of each elongate member 80.8 is generally triangular in shape in lateral profile in this example.

The lower peripheral portions 99.8 of the elongate members are outwardly convex in lateral profile in this example, with trailing edges 91.8 of the elongate members being rounded in this example.

Many advantages may result from the structure of the present invention. The assemblies as herein described, with their elongate members thereof, may comprise improved Coandă screens optimized to take advantage of Coandă and surface-tension effects. The assemblies as herein described, with their elongate members thereof, may function to: increase water intake capacity per unit area of screen; decrease elongate member profile erosion by sediment; decrease sensitivity to elongate member profile erosion by sediment; decrease sensitivity to plugging by organic material; and/or increase self-cleaning capabilities.

The assemblies herein described use the Coandă effect on the scale of the individual elongate members as opposed to slicing the fluid.

One of the primary structural differences between the assemblies as herein described and the known prior art is that the assemblies as herein described may use surface-tension effects or the Coandă effect to begin redirecting the water as it flows over the top of each elongate member, and not rely solely on the leading edge of the elongate member to turn the water flow. This may allow the leading edge of each elongate member to be effectively hidden behind the furthest protrusion of the next upstream elongate member into the water flow, deflecting rocks, sand, and organic debris away from the sharp edge of the screen. This may function to reduce wear on the leading edge of each elongate member and reduce the amount of organic debris that catches between the elongate members and plugs up the screen.

The structures as herein described may result in improved durability by using the stickiness of fully developed flow as opposed to prior art systems which slice undeveloped flow. This may result in the structures as herein described being less reliant on the sharpness of the leading edge of the screen profile. Since the leading edge may erode over time due to sediment, this may result in structures as herein described which are more long-lasting.

It will be appreciated that many elongate member design variations are possible within the scope of the invention described herein.

It should also be noted that the intake screen is not only applicable to hydropower plants, but can also be applied to any form of water intake structure such as a drinking water intake, cooling water intake, or industrial process water intake, for example.

ADDITIONAL DESCRIPTION

Examples of water intake structures have been described. The following clauses are offered as further description.

(1) A water intake structure comprising: a plurality of elongate members, the elongate members coupling together and being trapezoidal in lateral cross-section.

(2) The structure of clause 1 wherein exterior surfaces of the elongate members form parallelograms in shape in lateral cross-section.

(3) The structure of clause 1 wherein each said elongate member has at least one exterior surface that is outwardly concave.

(4) The structure of any one of clauses 1 to 2, wherein each said elongate member has an outer surface and an upstream-facing surface, the upstream-facing surface extending from the outer surface at an acute angle relative to the outer surface.

(5) The structure of clause 4 wherein each said outer surface is planar.

(6) The structure of clause 5 wherein each said upstream-facing surface is planar.

(7) The structure of any one of clauses 4 to 5 wherein each said upstream-facing surface is outwardly concave.

(8) The structure of any one of clauses 4 to 7 wherein the structure is positioned to enable water to flow above and along the outer surfaces of the elongate members, and to intake a portion of said water between adjacent said elongate members, with said portion of said water abutting said upstream-facing surfaces of the elongate members.

(9) The structure of any one of clauses 1 to 8 wherein each said elongate member has an inner surface that is planar and a downstream-facing surface that is planar.

(10) The structure of any one of clauses 4 to 6 wherein each said elongate member has a downstream-facing surface that extends in parallel with the upstream-facing surface thereof.

(11) The structure of any one of clauses 4 to 8 wherein each said elongate member has an inner surface that extends in parallel with the outer surface thereof.

(12) A water intake structure comprising: a plurality of elongate members, the elongate members coupling together and each said elongate member having first and second exterior surfaces that are planar and a third exterior surface that is outwardly concave.

(13) The structure of clause 12 wherein the third exterior surfaces are outer surfaces of the elongate members.

(14) The structure of any one of clauses 12 to 13 wherein the second exterior surface extends from the first exterior surface at an acute angle relative to the second exterior surface.

(15) The structure of any one of clauses 12 to 14 wherein each said elongate member is wedge-shaped in lateral cross-section.

(16) The structure of clause 12 wherein the third exterior surfaces are upstream-facing surfaces of the elongate members.

(17) The structure of any one of clauses 12 and 16, wherein each said second exterior surface extends perpendicular from its corresponding said first exterior surface.

(18) The structure of any one of clauses 12 and 16 to 17 wherein the first exterior surfaces are outer surfaces of the elongate members and the second exterior surfaces of the elongate members are downstream-facing surfaces of the elongate members.

(19) The structure of any one of clauses 13 and 18 wherein the structure is positioned to enable water to flow above and along the outer surfaces of the elongate members, and to intake a portion of said water between adjacent said elongate members, with said portion of said water abutting the upstream-facing surfaces of the elongate members.

(20) A water intake structure comprising: a plurality of elongate members, the elongate members coupling together and each said elongate member having an outer surface, an upstream-facing surface, and a downstream-facing surface, with the upstream-facing surface thereof extending from the outer surface thereof at an acute angle relative to the outer surface thereof, and with a beveled edge extending between the outer surface thereof and the downstream-facing surface thereof.

(21) A water intake structure comprising: a plurality of elongate members, the elongate members coupling together and each said elongate member being wedge-shaped in lateral cross-section, with an outer surface thereof positioned to extend in parallel with a flow of water thereon, and with each said elongate member having a downstream beveled edge.

(22) The structure of any one of clauses 20 to 21 wherein the structure is positioned to enable water to flow above and along the outer surfaces of the elongate members, and to intake a portion of said water between adjacent said elongate members, with said portion of said water abutting the upstream-facing surfaces of the elongate members.

(23) A water intake structure comprising: a plurality of elongate members, the elongate members coupling together and each said elongate member having an outer surface that is outwardly convex and an upstream-facing surface that is outwardly concave.

(24) The structure of clause 23 wherein each said elongate member is generally wedge-shaped in lateral cross-section.

(25) The structure of clause 23 wherein the upstream-facing surfaces of the elongate members are wider than the outer surfaces of the elongate members.

(26) The structure of clause 23 wherein the outer surfaces of the elongate members are wider than the upstream-facing surfaces of the elongate members.

(27) The structure of any one of clauses 23 to 26, wherein each said elongate member has an inner surface that is planar.

(28) The structure of clause 27 wherein the inner surfaces of the elongate members are sloped.

(29) The structure of any one of clauses 23 and 26, wherein each said elongate member includes a top portion and a bottom portion, with each said top portion being adjacent to the bottom portion of an adjacent said elongate member.

(30) A water intake structure comprising: a plurality of elongate members, the elongate members coupling together and each said elongate member having an outer surface aligned with a front of the structure, having a downstream-facing surface facing a bottom of the structure, and including a lower peripheral portion extending between the outer surface thereof and the downstream-facing surface thereof, the lower peripheral portion being curved in lateral profile at least in part.

(31) A water intake structure comprising: a plurality of elongate members, the elongate members coupling together and each said elongate member having an outer surface aligned with a front of the structure, having an upstream-facing surface facing a top of the structure, having a downstream-facing surface facing a bottom of the structure, an upper peripheral portion extending between the outer surface thereof and including a lower peripheral portion extending between the outer surface thereof and the downstream-facing surface thereof, the lower peripheral portion being sloped relative to the upper peripheral portion thereof.

(32) The structure of any one of clauses 1 to 31, wherein each said elongate member is a bar.

(33) The structure of any one of clauses 1 to 32, wherein the elongate members are positioned to promote the Coandă effect, with portions of the water being taken in thereby.

(34) The structure of any one of clauses 1 to 33, wherein the structure is a Coandă screen.

(35) In combination, a penstock having an inlet, and the structure of any one of clauses 1 to 34, the structure being positioned between the water to be taken in and the inlet of the penstock.

(36) In combination, a hydropower plant and the structure of any one of clauses 1 to 34.

It will be understood by someone skilled in the art that many of the details provided above are by way of example only and are not intended to limit the scope of the invention which is to be determined with reference to the following claims.

What is claimed is:

1. A water intake structure comprising:

a plurality of spaced-apart elongate members, wherein the improvement comprises each said elongate member including an elongate mount and an elongate outer cap coupled to the elongate mount thereof;

one or more support members extendable between upstream and downstream portions of water, the elongate mounts of the elongate members coupling to the one or more support members; and a plurality of slots, each extending between adjacent pairs of said elongate members, whereby the water passes along and upon the elongate outer caps of the elongate members, with portions of the water being taken in through said slots.

2. The water intake structure as claimed in claim 1 wherein each said elongate member has an outer surface with a streamlined shape.

3. The water intake structure as claimed in claim 1 wherein the one or more support members have a plurality of spaced-apart grooves extending therein, with each said elongate member selectively being received within a respective said groove.

4. In combination, a penstock having an inlet, and the water intake structure as claimed in claim 1, the structure being positioned between the water to be taken in and the inlet of the penstock.

5. The water intake structure as claimed in claim 1 wherein the elongate mounts of the elongate members are rigid.

6. The water intake structure as claimed in claim 1 wherein the elongate mounts of the elongate members are made of metal or another rigid material.

7. The water intake structure as claimed in claim 1 wherein the elongate mounts of the elongate members are planar.

8. The water intake structure as claimed in claim 1 wherein the outer caps of the elongate members are made of an elastomer or another polymer.

9. The water intake structure as claimed in claim 1 wherein each said outer cap selectively couples to and is removable from the elongate mount of the elongate member thereof.

10. The water intake structure as claimed in claim 1 wherein each said outer cap has a groove via which the elongate mount of the elongate member thereof is received.

11. A water intake structure comprising:

one or more support members extendable between upstream and downstream portions of water;

a plurality of spaced-apart elongate members, each including an inner portion that is rigid and an outer portion along and upon which the water flows, the outer portions of the elongate members connecting to and being selectively removable from respective said inner portions of the elongate members, and said inner portions of the elongate members connecting to and being selectively removable from the one or more support members; and a plurality of slots, each extending between adjacent pairs of said elongate members, whereby the water passes along and upon the outer portions of the elongate members, with portions of the water being taken in through said slots.

12. The water intake structure as claimed in claim 11 wherein said inner portions of the elongate members are made of metal or another rigid material, and wherein said outer portions of the elongate members are made of an elastomer or other polymer.

13. The water intake structure as claimed in claim 11 wherein said inner portions of the elongate members are elongate mounts and wherein said outer portions of the elongate members are elongate outer caps.

14. An elongate member for a water intake structure, the elongate member having an outer surface and a forward surface extending downwards from the outer surface thereof at an acute angle relative to the outer surface thereof, wherein one of said surfaces is curved at least in part, wherein the elongate member has a leading edge between a top surface thereof and the forward surface thereof, with the leading edge of the elongate member being sharp to promote and improve flow of water thereon and therepast, and wherein said elongate member has at least one of: an exterior said surface that is outwardly concave and an exterior said surface that is outwardly convex, wherein said elongate member has at least one of an exterior said surface that is outwardly concave or outwardly convex.

15. The elongate member as claimed in claim 14 wherein the outer surface of said elongate member is outwardly convex.

16. The elongate member as claimed in claim 14, wherein the forward surface of said elongate member is outwardly concave.

17. The elongate member as claimed in claim 14 wherein said elongate member is wedge-shaped in lateral cross-section.

18. The elongate member as claimed in claim 14, wherein said elongate member includes an upper peripheral portion extending between the outer surface thereof and the forward surface thereof, the upper peripheral portion being curved in lateral profile at least in part.

19. The elongate member as claimed in claim 14, wherein the outer surface thereof is outwardly convex and the forward surface thereof is outwardly concave.

20. The elongate member as claimed in claim 14, further including an upper peripheral portion extending between the outer surface thereof and the forward surface thereof, the upper peripheral portion being triangular in lateral profile.

* * * * *